US008342510B2

(12) United States Patent
Ito

(10) Patent No.: US 8,342,510 B2
(45) Date of Patent: Jan. 1, 2013

(54) APPARATUS FOR FEEDING SHEETS, BOOKLETS OR THE LIKE AND SYSTEM FOR SORTING FORWARDING DOCUMENTS

(75) Inventor: Yuhiko Ito, Kiyosu (JP)

(73) Assignee: Ezawa Jimuki Co., Ltd., Aichi-Ken (JP)

( * ) Notice: Subject to any disclaimer, the term of this patent is extended or adjusted under 35 U.S.C. 154(b) by 273 days.

(21) Appl. No.: 12/988,552

(22) PCT Filed: Mar. 5, 2010

(86) PCT No.: PCT/JP2010/053621

§ 371 (c)(1),
(2), (4) Date: Oct. 19, 2010

(87) PCT Pub. No.: WO2010/104003

PCT Pub. Date: Sep. 16, 2010

(65) Prior Publication Data

US 2011/0036757 A1 Feb. 17, 2011

(30) Foreign Application Priority Data

Mar. 9, 2009 (JP) ..... 2009-055036
Oct. 14, 2009 (JP) ..... 2009-237131

(51) Int. Cl.
*B65H 3/04* (2006.01)
*B65H 3/52* (2006.01)

(52) U.S. Cl. ..... 271/124; 271/35; 271/125; 271/137; 271/121

(58) Field of Classification Search ..... 271/35, 271/124, 125, 137, 121
See application file for complete search history.

(56) References Cited

U.S. PATENT DOCUMENTS 2,635,874 A * 4/1953 La Bore ..... 271/35

FOREIGN PATENT DOCUMENTS

JP 01167131 A * 6/1989

(Continued)

OTHER PUBLICATIONS

International Search Report issued in corresponding International Application No. PCT/JP2010/053621, mailed Mar. 30, 2010.

(Continued)

*Primary Examiner* — Luis A Gonzalez
(74) *Attorney, Agent, or Firm* — Oliff & Berridge, PLC

(57) ABSTRACT

Provided are an apparatus for feeding sheets, booklets or the like having a wider adjustable range according to the thickness of the object than the conventional apparatus, and a system for sorting forwarding documents with the foregoing feeding apparatus. In the feeding apparatus, a moving shaft is supported by a fixed sleeve so as to be movable upward and downward. A main compression coil spring is located between the moving shaft and the fixed base and imparts a main spring force to the moving shaft in order that an overlap feed limiting member is pressed against a conveying belt. A sub compression coil spring imparts an oppositely directed sub spring force to the moving shaft. A position of a pressing washer is displaced downward by a threading engagement of an upper end adjusting bolt, so that even when the spring force of the main compression coil spring is increased, an increased amount is cancelled by an increase in the spring force of the sub compression coil spring.

19 Claims, 21 Drawing Sheets

FOREIGN PATENT DOCUMENTS

| | | |
|---|---|---|
| JP | A 6-504022 | 5/1994 |
| JP | A 11-504308 | 4/1999 |
| JP | B1 3961561 | 8/2007 |
| JP | A 2008-230793 | 10/2008 |
| JP | B1 4394741 | 1/2010 |
| JP | B1 4424692 | 3/2010 |
| WO | WO 92/12085 | 7/1992 |
| WO | WO 97/30916 | 8/1997 |

OTHER PUBLICATIONS

Written Opinion of the International Searching Authority issued in corresponding International Application No. PCT/JP2010/053621, mailed Mar. 30, 2010.

* cited by examiner

APPARATUS FOR FEEDING SHEETS, BOOKLETS OR THE LIKE AND SYSTEM FOR SORTING FORWARDING DOCUMENTS

TECHNICAL FIELD

The present invention relates to an apparatus which extracts and feeds sheets, booklets or the like or a plurality of thin documents to be conveyed all stacked in the up-down direction, piece by piece or one by one from a lowest one and a system for sorting forwarding documents which sequentially discharges each one of a plurality of sets of forwarding documents stacked, each set including one booklet and any number of sheets.

BACKGROUND ART

A conventional apparatus for feeding sheets, booklets or the like as shown in FIG. 20 comprises an overlap feed limiting mechanism 2 provided in front of a stack loading section 1 on which a plurality of objects to be conveyed (printing paper, for example) are loaded in a vertically stacked state, and a feeding belt 3 provided below the stack loading section 1 and the overlap feed limiting mechanism 2. The feeding belt 3 is rotated so that the object extracted from the underside of the stack loading section 1 is fed through a gap between an overlap feed limiting member 4 provided at a lower end of the overlap feed limiting mechanism 2 and the feeding belt 3. In this case, adjustment of the overlap feed limiting mechanism 2 is executed so that the objects are fed one by one (or so that the objects are not fed in an overlapped state). For this purpose, the overlap feed limiting mechanism 2 is provided with a shaft insertion hole 5A formed through a fixed base 5 in the up-down direction and a moving shaft 6 inserted into the shaft insertion hole 5A. The moving shaft 6 has a lower end with which the overlap feed limiting member 4 is threadingly engaged, and the moving shaft 6 has an upper end with which an operating knob 7 is threadingly engaged. Furthermore, the moving shaft 6 includes a part exposed below the shaft insertion hole 5A, and a compression coil spring 8 is inserted into the outside of the part of the moving shaft 6 so as to be compressed between the overlap feed limiting member 4 and an upper end side open edge of the shaft insertion hole 5A. For example, when the object has a relatively larger thickness, the operating knob 7 is operated for a thread engagement advancing operation so that a gap (hereinafter, "nip gap") between the overlap feed limiting member 4 and the feeding belt 3 is rendered larger. When the object has a relatively smaller thickness, the operating knob 7 is operated so that a thread engagement retreating operation is carried out thereby to render the nip gap smaller. Thus, the nip gap is adjusted so that the objects are fed one by one irrespective of the differences in the thickness thereof (refer to patent document 1, for example).

PRIOR ART DOCUMENT

Patent Document 1: Japanese Patent Application Publication (Translation of PCT Application) JP-A-H11-504308 (pages 12 and 13, FIG. 4)

DISCLOSURE OF THE INVENTION

Problem to be Overcome by the Invention

In the above-described conventional feeding apparatus, however, the overlap feed limiting member 4 is thrust up a predetermined amount by the object thereby to be inserted into the gap between the limiting member 4 and the feeding belt 3, wherein part of the upthrust amount of the overlap feed limiting member 4 is merely changed according to the nip gap. Accordingly, the limiting member 4 is thrust up by the object, and the spring 8 is elastically deformed. A maximum amount of deformation of the spring 8 in this case is varied only by the thickness of the object but not by the adjustment of the operating knob 7. More specifically, in the case of an object with a relatively larger thickness, a resisting force by which the object thrusts up the limiting member 4 and enters into the gap between the limiting member 4 and the feeding belt 3 uniformly becomes larger. In the case of an object with a relatively smaller thickness, a resisting force by which the object thrusts up the limiting member 4 and enters into the gap between the limiting member 4 and the feeding belt 3 uniformly becomes smaller. As a result, when an object is relatively thicker, an allowable range of variations in the thickness of the object becomes small such that even one object sometimes cannot pass through the gap between the limiting member 4 and the feeding belt 3. When an object is relatively thinner, the allowable range of variations in the thickness of the object becomes large such that two overlapped objects sometimes can pass through the gap between the limiting member 4 and the feeding belt 3. Thus, an adjustable range of the gap between the limiting member 4 and the feeding belt 3 according to the thickness of the object is narrow in the conventional feeding apparatus.

The present invention was made in view of the foregoing circumstances and an object thereof is to provide an apparatus for feeding sheets, booklets or the like, which apparatus has a wider adjustable range according to the thickness of the object than the conventional apparatus, and a system for sorting forwarding documents provided with the foregoing feeding apparatus.

Means for Overcoming the Problem

An apparatus (100) for feeding sheets, booklets or the like, in accordance with claim 1 of the invention includes a stack loading section (70) on which a plurality of thin objects (S, B) to be conveyed such as sheets, booklets or the like are stacked and placed in the up-down direction; a rotating member (63) which is brought into frictional contact with the objects (S, B) sequentially from a lower end side of the stack loading section (70), thereby extracting forward and slidingly feeding the objects (S, B); and an overlap feed limiting member (30) disposed in front of the stack loading section (70) to hold the extracted objects (S, B) between the rotating member (63) and the limiting member (30), wherein the objects (S, B) which are allowed to pass between the rotating member (63) and the overlap feed limiting member (30) are limited to one by one, characterized by a moving base (29, 29D, 29E, 29F, 29H, 29M, 29P, 29S) supporting the overlap feed limiting member (30); a fixed base (11, 11P, 11S, 162, 165, 166, 199) supporting the moving base (29, 29D, 29E, 29F, 29H, 29M, 29P, 29S) vertically movably; a main elastic member (25, 25P, 25S, 25T, 25V, 167, 173, 198) which is mounted between the moving and fixed bases (29, 29D, 29E, 29F, 29H, 29M, 29P, 29S; and 11, 11P, 115, 162, 165, 166, 199) in an elastically deformed state, the main elastic member (25, 25P, 25S, 25T, 25V, 167, 173, 198) imparting a main elastic force to the moving base (29, 29D, 29E, 29F, 29H, 29M, 29P, 29S), the main elastic force acting to press the overlap feed limiting member (30) against the object (S, B); a sub elastic member (26, 26P, 265, 26T, 26V, 168, 174, 197) which is provided between the moving and fixed bases (29, 29D, 29E, 29F, 29H, 29M, 29P, 295; and 11, 11P, 115, 162, 165, 166, 199) in an elastically deformed state, the sub elastic member (26, 26P, 265, 26T, 26V, 168, 174, 197) imparting a sub elastic force to the moving base (29, 29D, 29E, 29F, 29H, 29M, 29P, 295), the sub elastic force acting in a direction opposite to the main elastic force; and a deformation amount adjusting mechanism (22C, 152K, 158K, 163K, 165K, 177K, 181K, 190K) which changes amounts of elastic deformation of the respective main and sub elastic members (25, 25P, 25S, 25T, 25V, 167, 173, 198; and 26, 26P, 26S, 26T, 26V, 168, 174, 197) in a non-hold state where no object (S, B) is held between the rotating member (63) and the overlap feed limiting member (30).

In the description of claim 1, the phrase "between the moving base and fixed bases" in "mounted between the moving and fixed bases in an elastically deformed state" has a meaning of in the middle of a force transmission path between the moving and fixed bases.

The invention of claim 2 is characterized in that the feeding apparatus (100) described in claim 1 further includes a shaft insertion hole (11A, 162A) passing through the fixed base (11, 162) vertically; a moving shaft (20, 163) provided on the moving base (29, 29M) so as to extend upward/downward, the moving shaft (20, 163) being inserted through the shaft insertion hole (11A, 162A) and having upper and lower ends both projecting outside the shaft insertion hole (11A, 162A); an upper end pressurizing member (23B, 160) which is provided on the upper end of the moving shaft (20, 163) so as to be moved in the up-down direction together with the moving shaft (20, 163) and being opposed to the fixed base (11, 162) from above; a lower end pressurizing member (40, 161) which is provided on the lower end of the moving shaft (20, 163) so as to be moved in the up-down direction together with the moving shaft (20, 163) and being opposed to the fixed base (11, 162) from below; wherein the main elastic member (25) is mounted between the lower end pressurizing member (40, 161) and the fixed base (11, 162) in a vertically compressively deformed state; the sub elastic member (26) is mounted between the upper end pressurizing member (23B, 160) and the fixed base (11, 162) in a vertically compressively deformed state; and the deformation amount adjusting mechanism (22C, 163K) changes and fixes a distance between a pair of elastic member abutment portions (23B, 40, 160, 161) of the upper and lower end pressurizing members (23B, 160; and 40, 161), against which portions the main and sub elastic members (25; and 26) abut respectively.

The invention of claim 3 is characterized in that the feeding apparatus (100) described in claim 1 further includes an upper shaft support wall (150, 152) and a lower shaft support wall (151) both of which are provided on the fixed base (11P) and are opposed to each other in the up-down direction; shaft insertion holes (151A, 152C) passing through the upper and lower shaft support walls (150, 152; and 151) in the up-down direction respectively; a moving shaft (20P) which is provided on the moving base (29P) so as to extend in the up-down direction, the moving shaft (20P) having two vertical portions inserted through the shaft insertion holes (151A, 152C) of the upper and lower shaft support walls (150, 152; and 151) so as to be supported movably in the up-down direction, respectively; and an intermediate abutment (21P) which bulges sideways from a middle portion of the moving shaft (20P) and is movable together with the moving shaft (20P) in the up-down direction, the intermediate abutment (21P) being opposed to the upper and lower support walls (150, 152; and 151) in the up-down direction, wherein the main elastic member (25P) is mounted between the intermediate abutment (21P) and the upper shaft support wall (150, 152) in a vertically compressively deformed state; the sub elastic member (26P) is mounted between the intermediate abutment (21P) and the lower shaft support wall (151) in a vertically compressively deformed state; and the deformation amount adjusting mechanism (152K) changes and fixes a distance between a pair of elastic member abutment portions (151, 152) of the upper and lower shaft support walls (150, 152; or 151), against which portions the main and sub elastic members (25P; and 26P) abut respectively.

The invention of claim 4 is characterized, in the feeding apparatus (100) described in claim 1, further by a fixed shaft (154) which is provided on the fixed base (11S) so as to extend in the up-down direction; an upper end elastic member receiving portion (153) and a lower end elastic member receiving portion (155) both of which are provided on the fixed base (115) so as to be disposed on both vertical ends of the fixed shaft (154), the upper and lower end member receiving portions (153; 155) being opposed to each other in the up-down direction; and a vertical slide (154S) provided on the moving base (295) and having a shaft insertion hole (154H) through which the fixed shaft (154) extends in the up-down direction, the vertical slide (1545) being disposed between the upper and lower end elastic member receiving portions (153; 155), wherein the main elastic member (25S) is mounted between the vertical slide (1545) and the upper end elastic member receiving portion (153) in a vertically compressively deformed state; the sub elastic member (26S) is mounted between the vertical slide (1545) and the lower end elastic member receiving portion (155) in a vertically compressively deformed state; and the deformation amount adjusting mechanism (158K) changes and fixes a distance between a pair of elastic member abutment portions (153; 155) of the upper and lower end elastic member receiving portions (153; 155), against which portions the main and sub elastic members (25S; 26S) abut respectively.

The invention of claim 5 is characterized, in the feeding apparatus (100) described in claim 1, further by a shaft insertion hole (166A) passing through the fixed base (165, 166) in the up-down direction; a moving shaft (169) which is provided on the moving base (29D) so as to extend in the up-down direction and, is inserted through the shaft insertion hole (166A), the moving shaft (169) having upper and lower ends protruding out of the shaft insertion hole (166A); and a moving abutment member (171) which is movable in the up-down direction together with the moving shaft (169) and is opposed to the fixed base (165, 166) from above, wherein the main elastic member (167) has upper and lower ends mounted on the moving abutment member (171) and the fixed base (165, 166) in a vertically tensionally deformed state; the sub elastic member (168) is mounted between the moving abutment member (171) and the fixed base (165, 166) in a vertically compressively deformed state; and the deformation amount adjusting mechanism (165K) changes and fixes a distance between a pair of elastic member abutment portions (166, 171) of the moving abutment member (171) and fixed base (165, 166), against which portions both ends of the sub elastic member (168) abut respectively.

The invention of claim 6 is characterized, in the feeding apparatus (100) described in claim 1, further by a shaft insertion hole (166A) passing through the fixed base (165, 166) in the up-down direction; a moving shaft (169) which is provided on the moving base (29E) so as to extend in the up-down direction and is inserted through the shaft insertion hole (166A), the moving shaft (169) having upper and lower ends protruding out of the shaft insertion hole (166A); and a moving abutment member (171V) which is movable in the up-down direction together with the moving shaft (169) and is opposed to the fixed base (165, 166) from below, wherein the main elastic member (173) is mounted between the moving abutment member (171V) and the fixed base (165, 166) in a vertically compressively deformed state; the sub elastic member (174) has upper and lower ends mounted on the moving abutment member (171V) and the fixed base (165, 166) in a vertically tensionally deformed state; and the deformation amount adjusting mechanism (165K) changes and fixes a distance between a pair of elastic member abutment portions (166, 171V) of the moving abutment member (171V) and fixed base (165, 166), against which portions the ends of the main elastic member (173) abut respectively.

The invention of claim 7 is characterized, in the feeding apparatus (100) described in claim 1, further by a pivotal lever (178A) which is provided on the moving base (29F) and pivotally supported on the fixed base (11P) so as to extend substantially horizontally and so as to be vertically reciprocable; and an upper pressure bearing wall (177, 179) and a lower pressure bearing wall (180) both of which are provided on the fixed base (11P) so as to be opposed to each other in the up-down direction with the pivotal lever (178A) being interposed therebetween, wherein the main elastic member (25T) is mounted between the upper pressure bearing wall (177, 179) and the pivotal lever (178A) in a vertically compressively deformed state; the sub elastic member (26T) is mounted between the lower pressure bearing wall (180) and the pivotal lever (178A) in a vertically compressively deformed state; and the deformation amount adjusting mechanism (177K) changes and fixes a distance between a pair of elastic member abutment portions (177; 180) of the upper and lower pressure bearing walls (177, 179; 180), against which portions the main and sub elastic members (25T; 26T) abut respectively.

The invention of claim 8 is characterized, in the feeding apparatus (100) described in claim 1, further by a pivotal lever (178A) which is provided on the moving base (29F) and pivotally supported on the fixed base (11P) so as to extend substantially horizontally and so as to be vertically reciprocable; and an upper support wall (181, 184) and a lower support wall (185) both of which are provided on the fixed base (11P) so as be opposed to each other in the up-down direction with the pivotal lever (178A) being interposed therebetween, wherein the main elastic member (25V) is mounted between the lower support wall (185) and the pivotal lever (178A) in a vertically tensionally deformed state; the sub elastic member (26V) is mounted between the upper support wall (181, 184) and the pivotal lever (178A) in a vertically tensionally deformed state; and the deformation amount adjusting mechanism (181K) changes and fixes a distance between a pair of elastic member abutment portions (182, 185) of the upper and lower support walls (181, 184; 185), on which portions the main and sub elastic members (25V, 26V) are mounted respectively.

The invention of claim 9 is characterized, in the feeding apparatus (100) described in claim 1, further by a pivotal lever (186A, 186B) which is provided on the moving base (29H) and pivotally supported on the fixed base (199) so as to extend substantially horizontally and so as to be vertically reciprocable; a main torsion coil spring (198) serving as the main elastic member (198) and having one of two ends which abuts against a part (188A) of the pivotal lever (186A, 186B) and the other end which abuts against a part (189) of the fixed base (199), thereby biasing the pivotal lever (186A, 186B) downward; and a sub torsion coil spring (197) serving as the sub elastic member (197) and having one of two ends which abuts against another part (188B) of the pivotal lever (186A, 186B) and the other end which abuts against another part (192) of the fixed base (199), thereby biasing the pivotal lever (186A, 186B) upward, wherein the deformation amount adjusting mechanism (190K) is provided on the fixed base (109) and moves and fixes the part against which either the main or sub torsion coil spring (197; 198) abuts to any position about a twisted axis of the torsion coil spring (197, 198).

The invention of claim 10 is characterized in that in the feeding apparatus (100) described in claim 3, the main and sub elastic members (25P; 26P) comprise compression coil springs (25P; 26P) inserted through the moving shaft (20P) respectively.

The invention of claim 11 is characterized in that in the feeding apparatus (100) described in claim 4, the main and sub elastic members (25S; 26S) comprise compression coil springs (25S; 26S) inserted through the fixed shaft (154) respectively.

The invention of claim 12 is characterized in that in the feeding apparatus (100) described in claim 5 or 6, one of the main and sub elastic members (167, 173; 168, 174) which is compressively deformed comprises a compression coil spring (168; 173) inserted through the moving shaft (169), and the other elastic member comprises a plurality of tension coil springs (167, 174) disposed about the moving shaft (169).

The invention of claim 13 is characterized in that in the feeding apparatus (100) described in any one of claims 1 to 8 and 10 to 12, the deformation amount adjusting mechanism (22C, 152K, 158K, 163K, 165K, 177K, 181K) is provided with a male thread (23A, 152, 158, 163A, 166, 177, 181) and a female screw hole (22N, 151B, 157, 164, 165N, 179N, 184N) both of which are threadingly engaged with each other, and the deformation amount adjusting mechanism (22C, 152K, 158K, 163K, 165K, 177K, 181K) changes elastic deformation amounts of the main and sub elastic members (25, 25P, 25S, 25T, 25V, 167, 173; 26, 26P, 26S, 26T, 26V, 168, 174) by changing a depth of threading engagement of the male thread and the female screw hole.

The invention of claim 14 is characterized, in the feeding apparatus (100) described in any one of claims 1 to 13, further by a lower end stopper (12, 21A) which is provided on a lower end of the fixed base (11) and abuts against the moving base (29) when the moving base (29) is moved downward thereby to forbid the moving base (29) from moving downward from the abutment position, and a lower end stopper movement operating portion (42) which renders the lower end stopper (12, 21A) movable in the up-down direction by a threading engagement operation.

The invention of claim 15 is characterized in that in the feeding apparatus (100) described in any one of claims 1 to 13, the overlap feeding limiting member (30) is disposed at a position spaced from the rotating member (63) in the non-hold state.

The invention of claim 16 is characterized, in the feeding apparatus (100) described in any one of claims 1 to 13, further by an upper end stopper (13) which is provided on the lower end of the fixed base (11) and abuts against the moving base (29) when the moving base (29) is moved upward thereby to forbid the moving base (29) from moving upward from the abutment position, and an upper end stopper movement operating portion (13) which renders the upper end stopper (13) movable in the up-down direction by a threading engagement operation.

The invention of claim 17 is characterized in that in the feeding apparatus (100) described in any one of claims 1 to 13, the overlap feeding limiting member (30) abuts against the rotating member (63) in the non-hold state.

A system (200) for sorting forwarding documents in accordance with the invention of claim 18 is characterized by the feeding apparatus (100) described in any one of claims 1 to 17, wherein a plurality of sets of forwarding documents are placed in a stacked state on the stack loading section (70), each set including one booklet (B) serving as the object (S, B) to be conveyed and any number of sheets (S) serving as the object (S, B) to be conveyed, the booklets and the sheets being passed between the rotating member (63) and the overlap feed limiting member (30) one by one from the objects (S, B) to be conveyed placed on the stack loading section (70) without discrimination between the booklet (B) and the sheet (S); and an aggregating unit (120, 126, 130, 131, 140) which determines whether the object (S, B) fed one by one from the feeding apparatus (100) is the booklet (B); and stacks, as a set of the forwarding documents, the objects ranging from the booklet (B) to the sheet (5) before a subsequent booklet (B) or from the sheet (S) next to the booklet (B) to the next booklet (B), thereby distinguishing and sequentially discharging the forwarding document sets one by one.

The invention of claim 19 is characterized in that in the sorting system (200) of claim 18, the aggregating unit (120, 126, 130, 131, 140) includes a determining sensor (131) which determines whether a character/pattern is printed on a surface of only the booklet (B) or only the sheet (S) out of the booklets (B) and the sheets (S), and the aggregating unit (120, 126, 130, 131, 140) determines whether the object (S, B) to be conveyed is the booklet (B), according to the result of determination by the determining sensor (131).

Effect of the Invention

[Invention of Claims 1 to 9]

In the feeding apparatus of claims 1 to 9, when the rotating member is rotated, the object is sequentially extracted forward from the lower end side of the stack loading section to be fed between the rotating member and the overlap feed limiting member. The objects to be conveyed are passed between the rotating member and the overlap feed limiting member one by one, whereupon the objects to be conveyed can be prevented from passing in a stacked state of plural objects.

In the feeding apparatus in accordance with the present invention, the moving base supporting the overlap feed limiting member is supported by the fixed base so as to be movable in the up-down direction. Between the moving and fixed bases are provided the main elastic member applying to the moving base the main elastic force for pressing the over feed limiting member against the object and the sub elastic member applying to the moving base the sub elastic force having a direction opposed to the main elastic force. Accordingly, when the overlap feed limiting member is thrust upward by the object, the object is subjected to a differential elastic force obtained by subtracting the sub elastic force from the main elastic force. The differential elastic force acts as a resisting force for the object to enter between the overlap feed limiting member and the rotating member, thereby allowing the objects to pass one by one and limiting the passing of the objects in a stacked state.

Furthermore, in the feeding apparatus in accordance with the invention, the deformation amount adjusting mechanism can change amounts of elastic deformation of the main and sub elastic members in the non-hold state where no object is held between the rotating member and the overlap feed limiting member. Since the sub elastic force of the sub elastic member is opposed to the main elastic force of the main elastic member as described above, the elastic deformation amount of the sub elastic force is also increased or decreased when the elastic deformation amount of the main elastic force is increased or decreased. An increase or decrease of the main elastic member and an increase or decrease of the sub elastic member in the non-hold state is counterbalanced. Accordingly, when the main and sub elastic members are elastically deformed from a state where the main and sub elastic forces are the same and are balanced, a composite elastic force of the main and sub elastic forces, i.e., the resisting force for the object to enter between the overlap feed limiting member and the rotating member is the same regardless of amounts of elastic deformation of the main and sub elastic members. On the other hand, changes in the elastic deformation amounts of the main and sub elastic members by the deformation amount adjusting mechanism also change the position of the overlap feed limiting member (hereinafter referred to as an "elastic force balanced position") in the balanced state of the main and sub elastic forces. More specifically, according to the present invention, changes in the composite force of the main and sub elastic forces can be rendered constant when the overlap feed limiting member is moved from the elastic force balanced position, regardless of the elastic force balanced position of the overlap feed limiting member to be changed by the deformation amount adjusting mechanism.

Consequently, the resisting force to push the object between the overlap feed limiting member and the rotating member is adjustable so as not to vary both when the elastic force balanced position of the overlap feed limiting member is moved to a relatively lower position by the deformation amount adjusting mechanism for relatively thinner objects and when the elastic force balanced position of the overlap feed limiting member is moved to a relatively higher position by the deformation amount adjusting mechanism for relatively thicker objects. Furthermore, when amounts of elastic deformation of the main and sub elastic members are changed by the deformation amount adjusting mechanism for the objects having the same thickness, the resisting force to push the object between the overlap feed limiting member and the rotating member can also be changed suitably. More specifically, according to the feeding apparatus in accordance with the present invention, the adjustment to feed the objects one by one according to the thickness of the objects can be realized. In other words, an adjustable range according to the thickness of the objects is broadened as compared with the conventional feeding apparatuses.

[Invention of Claims 10, 11 and 12]

In the present invention as described above, the main and/or sub elastic member may comprise rubber, a leaf spring, a disc spring or a coil spring or another elastic member. Furthermore, when the main and/or sub elastic member comprises a compression coil spring and is disposed about the moving or fixed shaft as in claims 10 to 12, the compression coil spring can easily maintain the winding axis thereof in a linearly extending state, whereby the structure of the feeding apparatus can be simplified.

[Invention of Claim 13]

According to the configuration of claim 13, amounts of elastic deformation of the main and sub elastic members can continuously be changed by the threading engagement of the male thread and the female screw hole, whereby a fine adjustment can be realized.

[Invention of Claim 14]

According to the feeding apparatus of claim 14, when the lower end stoppers of the fixed and moving bases are abutted against each other in the non-hold state, the overlap feed limiting member can be disposed at a location spaced from the rotating member. When the abutment pressure between the lower end stoppers is changed by the deformation amount adjusting mechanism, an initial resisting force at the time of the object entering between the overlap feed limiting member and the rotating member can be changed suitably. Additionally, when the object is pressed between the overlap feed limiting member and the rotating member, the lower end stoppers depart from each other such that the differential elastic force of the main and sub elastic forces is applied to the object.

[Invention of Claim 15]

According to the feeding apparatus of claim 15, the size of the gap between the overlap feed limiting member and the rotating member in the non-hold state can be changed according to the thickness of the objects.

[Invention of Claim 16]

According to the feeding apparatus of claim 16, a maximum gap is formed between the overlap feed limiting member and the rotating member when the moving base is moved upward thereby to abut against the fixed base. The object with a larger thickness than the maximum gap can reliably be forbidden from passing. Furthermore, the upper end stopper is threadingly engaged with the fixed base, whereby the size of the maximum gap can be changed.

[Invention of Claim 17]

According to the feeding apparatus of claim 17, the abutment pressure under the condition where the overlap feed limiting member is in abutment with the rotating member in the non-hold state is changed by the deformation amount adjusting mechanism. As a result, an initial resisting force at the time of the object entering between the overlap feed limiting member and the rotating member can be changed suitably. Additionally, when the object is pressed between the overlap feed limiting member and the rotating member, the overlap feed limiting member is disengaged from the rotating member such that the differential elastic force of the main and sub elastic forces is applied to the object.

[Invention of Claim 18]

A system for sorting forwarding documents of claim 18 comprises the feeding apparatus described in any one of claims 1 to 17. Accordingly, the adjustable range according to the thickness of the objects is rendered wider than in the conventional systems and a fine adjustment according to the thickness of the objects can be realized. As a result, the booklets and the sheets can be fed one by one from each of object groups in each of which the sheets and the booklets are mixed. In the aggregating unit, whether the object is a booklet is determined, and the objects ranging from one booklet to the sheet before a subsequent booklet or from the sheet next to one booklet to the next booklet are stacked as a set of forwarding documents. The forwarding document sets can sequentially be distinguished and discharged one by one.

[Invention of Claim 19]

In the sorting system of claim 19, the determining sensor is provided which determines whether a character/pattern is printed on a surface of only the booklet or only the sheet out of the booklets and the sheets. As a result, a determination on whether the object is a booklet can easily be made.

BRIEF DESCRIPTION OF THE DRAWINGS

FIG. 21 is a conceptual diagram showing the principle of feeding of documents or the like.

BEST MODE FOR CARRYING OUT THE INVENTION

Figure 1:
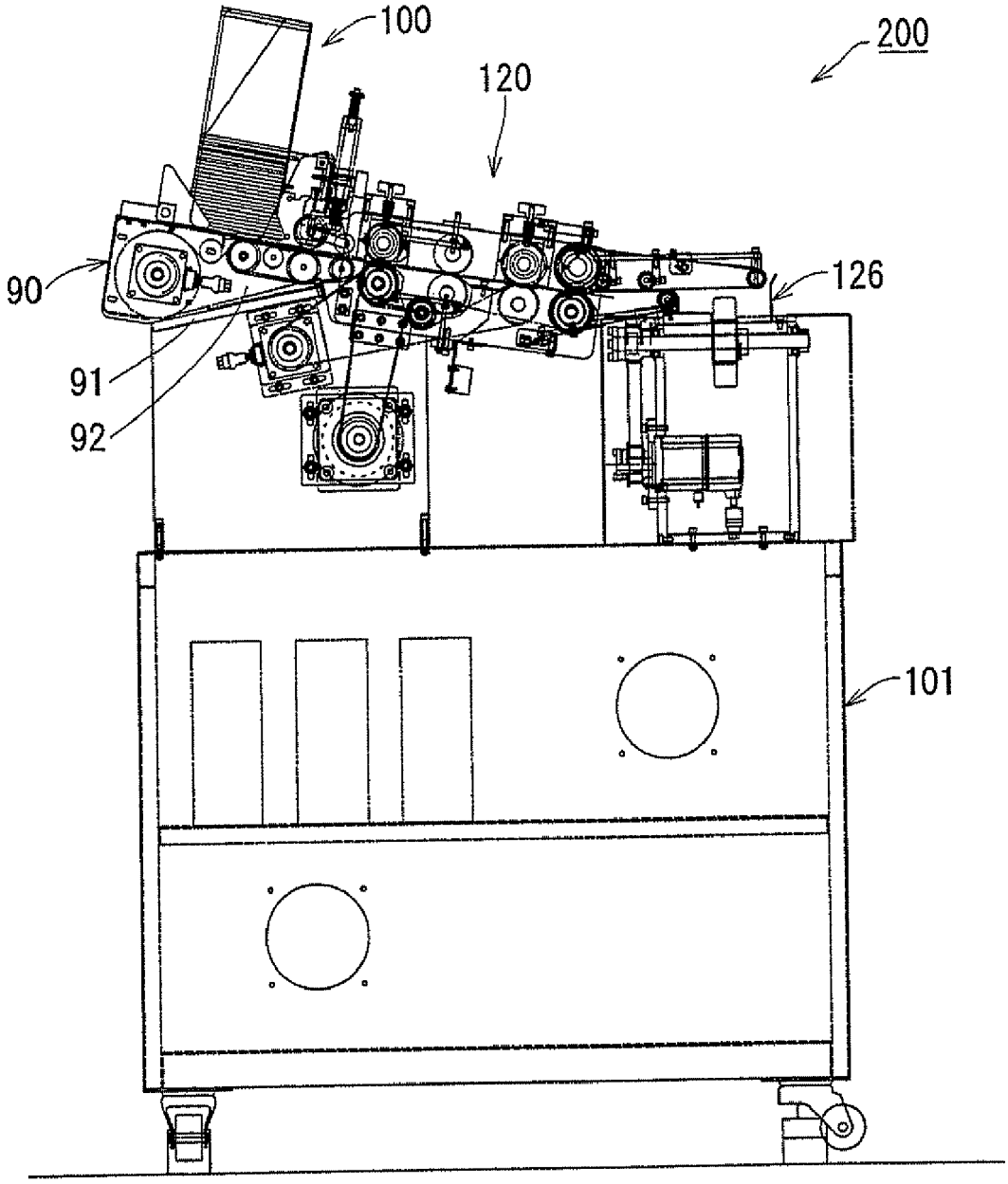
FIG. 1 is a side sectional view of a system for sorting forwarding documents and feeding apparatus in accordance with a first embodiment.

Hereinafter, an embodiment of a system 200 for sorting forwarding documents and a feeding apparatus 100 will be described with reference to FIGS. 1 to 9 and 21. The feeding apparatus 100 comprises a base frame 90 onto which various components are assembled, as shown in FIGS. 1 and 3. The base frame 90 includes a base plate 91 fixed to an upper surface of an apparatus mounting 101, side plates 92 which are provided on both sides of the base plate 91 so as to be opposed to each other in a horizontal direction (the direction perpendicular to the plane of the sheet of FIGS. 1 to 3), and a cover plate 93 (see FIG. 2) connecting rear ends of the side plates 92. The cover plate 93 is inclinedly mounted relative to a horizontal plane so as to be lowered toward the front of base frame 90 (the right side in FIG. 2). Only one of the side plates 92 is shown in FIGS. 1 to 3.

Figure 2:
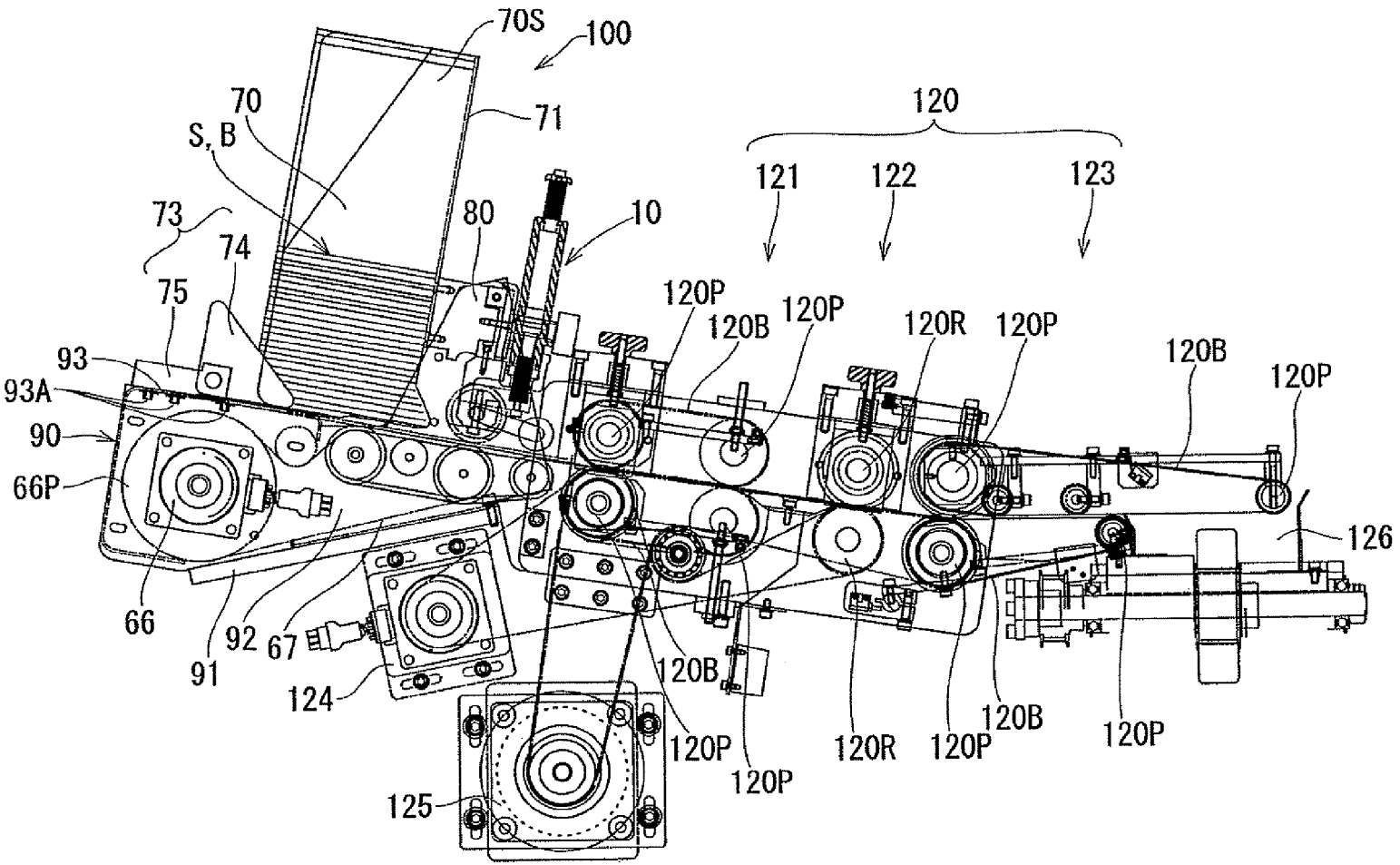
FIG. 2 is a side sectional view of the system for sorting forwarding documents and feeding apparatus.
Figure 3:
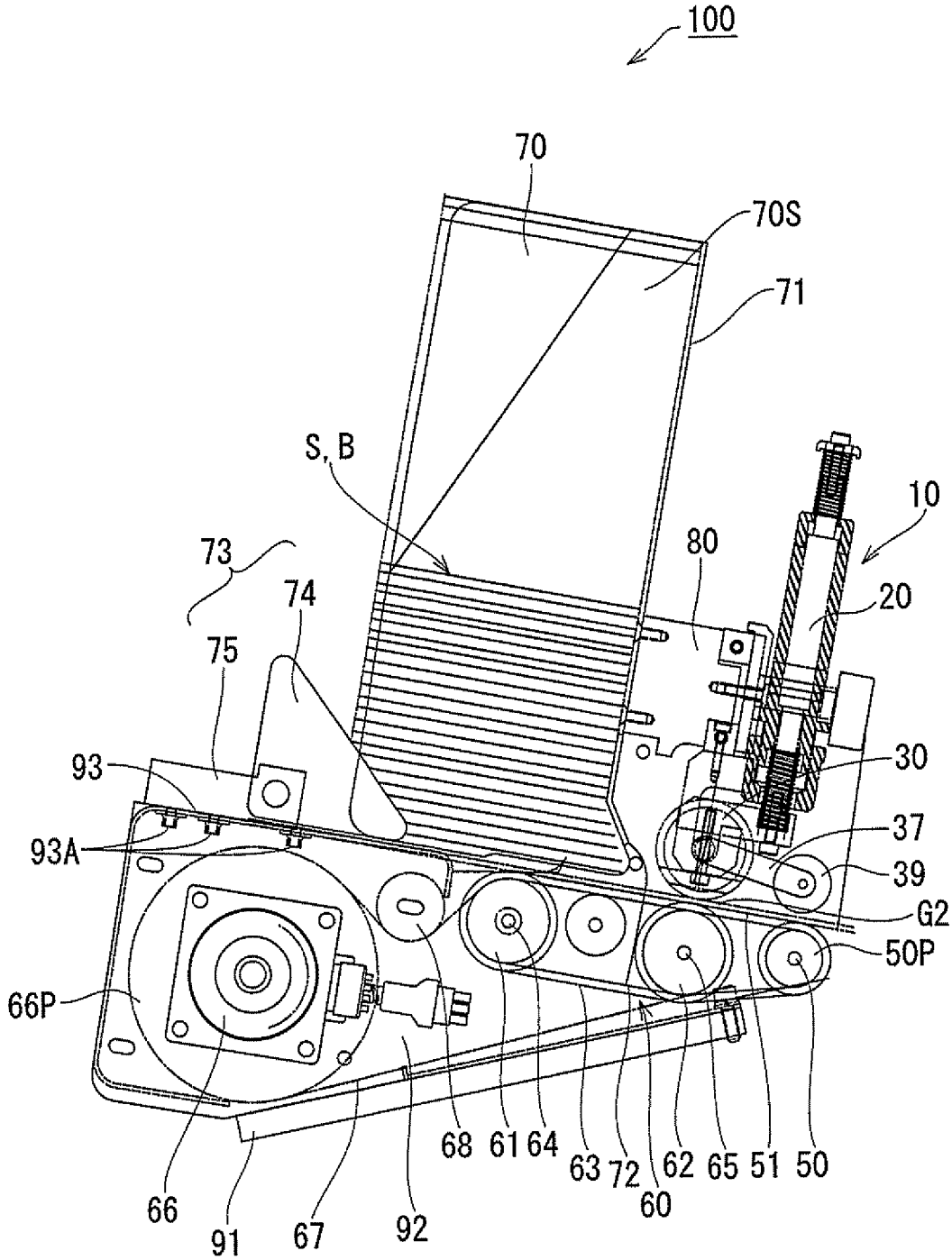
FIG. 3 is a side sectional view of the feeding apparatus.

A stack loading section 70 stands on an upper surface of the base frame 90 as shown in FIG. 2. The stack loading section 70 has a pair of sidewalls 70S (only one sidewall 70 is shown in FIG. 2) which stand upright from both sides of the upper surface of the base frame 90 respectively so as to be opposed to each other and a front wall 71 which connects between the front edges of the sidewalls 70S. The front wall 71 stands upright on the upper surface of the base frame 90 and has a lower end which is bent obliquely downward toward the front. A document outlet 72 is formed between a lower edge of the bent portion of the front wall 71 and the upper surface of the base frame 90. A sheet of paper S or a booklet B into which a plurality of sheets S are stacked and bound (hereinafter, these are referred to as "documents S, B") serves as the object to be conveyed of the present invention and is placed inside the stack loading section 70 so as to be laid on the top of another in the up/down direction. The documents S and B are drawn frontward from the document outlet 72.

An end stirring member 73 is provided on a part of the upper surface of the cover plate 93 in the rear of the stack loading section 70. The end stirring member 73 includes a plurality of triangular plates 74 arranged in a width direction of the base frame 90 (the direction in which the side plates 92 are opposed to each other) and a mounting bracket 75 for mounting the triangular plates 74 to the cover plate 93. The triangular plates 74 and the mounting bracket 75 are formed integrally with each other. Each triangular plate 74 has a forwardly downward inclined surface. The inclined surface is pressed against the lower ends of the documents S, and B placed in the stack loading section 70 from the rear, whereby the documents S, B on the lower end of the stack loading section 70 are dissected out so as to be gradually stirred frontward toward the lower part. The end stirring member 73 is fixed in position by threadingly engaging a bolt (not shown) passing through the mounting bracket 75 with a screw hole 93A of the cover plate 93. The cover plate 93 has a plurality of screw holes 93A arranged in the front-rear direction. Consequently, the position of the end stirring member 73 can selectively be adjusted in the front-rear direction according to dimensions of the documents S and B.

A part of the upper surface of the base frame 90 ranging from the lower position of the stack loading section 70 to the front position is constituted by a conveying belt 63 as shown in FIG. 3. More specifically, a rear pulley support shaft 64 is bridged between the side plates 92 of the base frame 90 right below the stack loading section 70, so that both ends thereof 90 are rotatably supported. A front pulley support shaft 65 is bridged between the side plates 92 of the base frame 90 in front of the rear pulley support shaft 64 so that both ends thereof are rotatably supported. An auxiliary pulley support shaft 50 is bridged between the side plates 92 of the base frame 90 further in front of the front pulley support shaft 65 so that both ends thereof are rotatably supported. A plurality of rear pulleys 61 are supported on the rear pulley support shaft 64 so as to be rotatable together. Corresponding to the rear pulleys 61, a plurality of front pulleys 62 are supported on the front pulley support shaft 65 so as to be rotatable together. A conveying belt 63 (serving as a rotating member of the present invention) made from elastomer is stretched between the corresponding rear and front pulleys 61 and 62 respectively. Furthermore, a plurality of rear auxiliary pulleys (not shown) are supported on the front pulley support shaft 65 so as to be rotatable together. The rear auxiliary pulleys and the front pulleys 62 are disposed alternately. A plurality of front auxiliary pulleys 502 are supported on the auxiliary pulley support shaft 50 so as to be rotatable together. Guide belts 51 made from elastomer are stretched between the corresponding rear and front auxiliary pulleys 502 respectively.

The conveying belt 63 and the guide belt 51A use a first servomotor 66 disposed below the cover plate 93 as a drive source. More specifically, an output pulley 662 is fixed to a rotation output section (not shown) of the first servomotor 66. Driving pulleys (not shown) are fixed to one of ends of the rear pulley support shaft 64 which penetrates one of the side plates 92. A timing belt 67 is stretched between the output pulley 66P and each driving pulley. A suitable tension is applied to the timing belt 67 by a tension roller 68.

The conveying belt 63 and the guide belt 51 have respective conveying surfaces directed upward and inclined substantially at the same angle as the upper surface of the cover plate 93 relative to a horizontal plane. The conveying belt 63 is brought into frictional contact with the underside of the lowermost document S, B of the documents S, B placed on the stack loading section 70 thereby to draw the document S, B forward from the document outlet 72 of the stack loading section 70 and slidingly feed the document B, C. The guide belt 51 is then brought into frictional contact with the underside of the slidingly fed document S, B thereby to further slidingly feed the document S, B forward.

The overlap feed limiting member 30 is provided at the position spaced forward from the document outlet 72 of the stack loading section 70. The overlap feed limiting member 30 is disposed above the front end of the conveying belt 63 and is supported by the linear motion support mechanism 10 shown in FIG. 4 so as to be movable in the up-down direction. The document S, B drawn out of the stack loading section 70 by the rotation of the conveying belt 63 is passed between the overlap feed limiting member 30 and the conveying belt 63.

Figure 5:
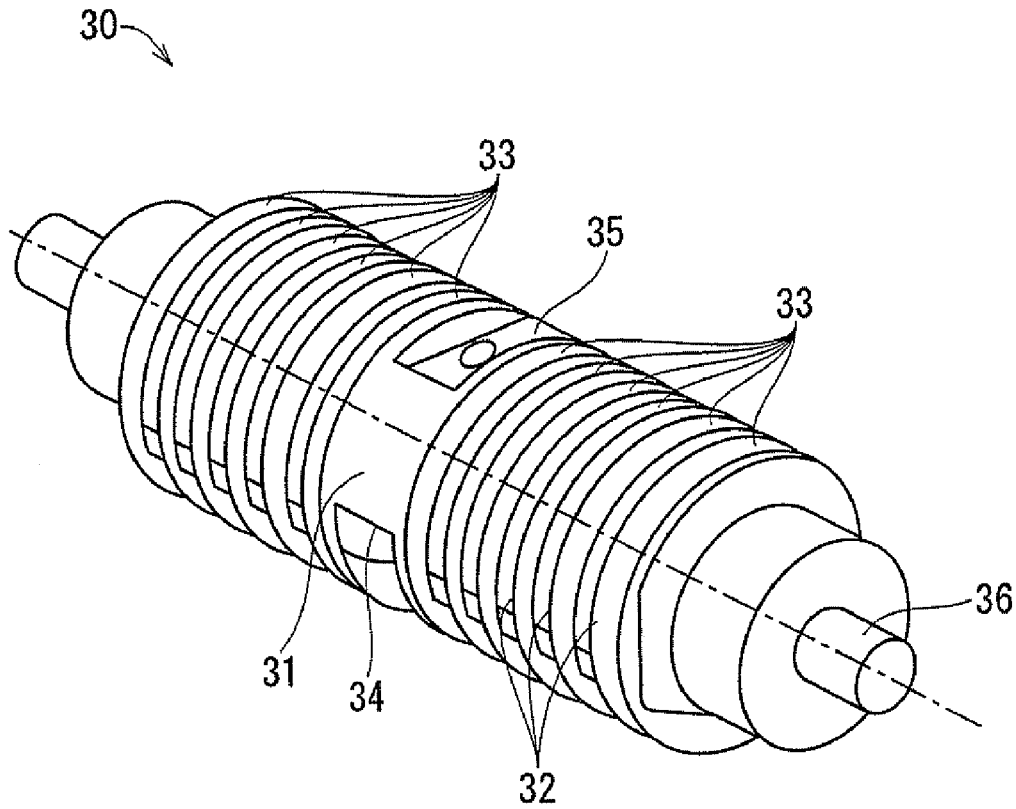
FIG. 5 is a perspective view of an overlap feed limiting member.

The overlap feed limiting member 30 includes a columnar portion 31 having a central axis that is parallel to the rear and front pulley support shafts 64 and 65. As shown in FIG. 5, a plurality of annular grooves 32 are formed on the outer circumferential surface of the columnar portion 31. A sliding contact ring 33 is attached to each annular groove 32. It is desirable that the columnar portion 31 comprises a resin or metal having a frictional coefficient ranging from about 0.15 to 0.35, for example and that the sliding contact ring 33 comprises an elastomer having a frictional coefficient ranging from about 0.5 to 0.7, for example.

Figure 4:
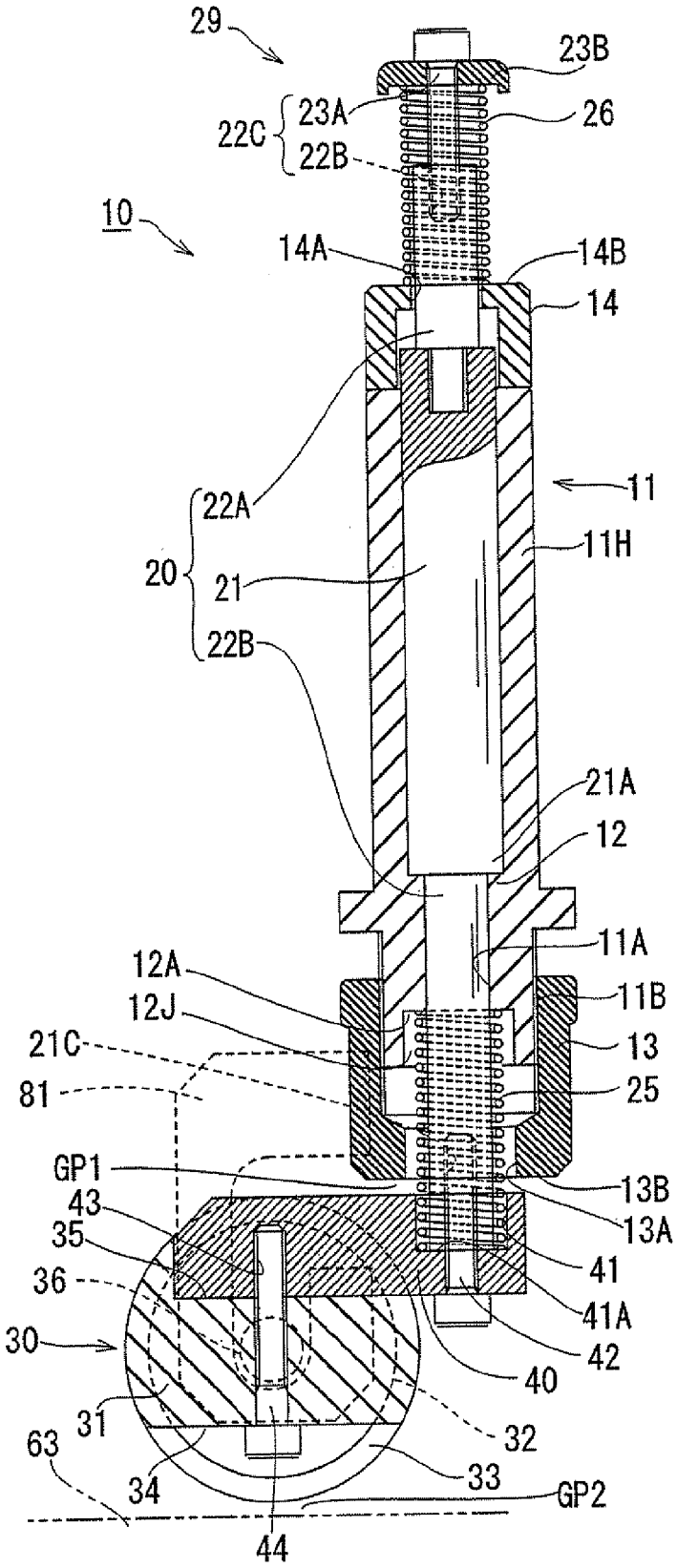
FIG. 4 is a side sectional view of a linear motion holding mechanism.

The overlap feed limiting member 30 includes a portion located opposite to the conveying surface of the conveying belt 63 at an axial middle thereof. An underside depression 34 formed on the portion by cutting the columnar portion 31 from an outer peripheral surface nearly to a central axis into a shape of a generally semicircle, as shown in FIG. 4. The columnar portion 31 is also formed with a connecting flat portion 35 which is located opposite to the underside depression 34 with the central axis thereof being interposed therebetween. The connecting flat portion 35 is formed by cutting a part of the outer circumferential surface of the columnar portion 31 into a flat shape. The sliding contact ring 33 slightly projects out of the outer circumferential surface of the columnar portion 31 only in the underside depression 34 of the outer circumferential surface of the columnar portion 31, while sunk in the annular groove 32 in the other portion thereof thereby not to protrude out of the outer circumferential surface of the columnar portion 31.

Columnar bosses 36 protrude sideways from both end surfaces of the overlap feed limiting member 30 respectively. A pair of retaining hooks 81 are provided on a component mount 80 which will be described later. The retaining hooks 81 are opposed to the columnar bosses 36 from below respectively, whereupon the overlap feed limiting member 30 is prevented from coming off the base frame 90 in a maintenance work or the like.

The linear motion support mechanism 10 is structured so that the moving base 29 supporting the overlap feed limiting member 30 is further supported by the fixed base 11 so as to be movable in the up-down direction. As shown in FIG. 4, the fixed base 11 comprises a cylindrical fixed base body 11H extending in the direction perpendicular to the upper surface of the cover plate 93 and a head cap 14 joined to the upper end of the fixed base body 11H. The head cap 14 is formed into a cylindrical shape with substantially the same diameter as the fixed base body 11H. An upper end through hole 14A having a smaller diameter than an inner diameter of the cylindrical wall is formed in the center of the ceiling wall of the head cap 14. Inner spaces of the fixed base body 11H and the head cap 14 communicate with each other thereby to serve as a shaft insertion hole 11A of the present invention. Furthermore, the shaft insertion hole 11A is narrowed at a position near a lower end thereof into a stepped shape, and this stepped portion serves as a lower end stopper 12. Furthermore, as shown in FIG. 3, the fixed base body 11H is fixed to a front surface of the stack loading section 70 via the component mount 80.

The fixed base body 11H has a lower end outer circumferential surface formed with a male thread 11B with which a cylindrical bottom cap 13 is threadingly engaged. The bottom cap 13 has a cylindrical wall inner surface formed with a female thread. The bottom wall has a central part formed with a lower end through hole 13A having a diameter smaller than an inner diameter of the cylindrical wall.

The moving base 29 has a connecting block 40 formed on a lower end of a moving shaft 20 extending in the up-down direction and serving as a lower end pressurizing member. The moving shaft 20 has an upper end provided with a pressing washer 23B serving as an upper end pressurizing member. The moving shaft 20 has smaller-diameter shafts 22A and 22B on upper and lower ends of a larger-diameter shaft 21 respectively. A bump between the larger-diameter shaft 21 and lower smaller-diameter shaft 22B serves as a lower end stopper 21A. When the lower end stopper 12 of the fixed base 11 and the lower end stopper 21A of the moving shaft 20 abut, the moving shaft 20 is positioned at a lower end position in a movable range thereof. In the positioned state, the upper smaller-diameter shaft 22A passes through the upper end through hole 14A thereby to protrude above the head cap 14 while the lower smaller-diameter shaft 22B passes through the lower end through hole 13A thereby to protrude below the bottom cap 13. Furthermore, a ball spline mechanism (not shown) is provided between an outer circumferential surface of the larger-diameter shaft 21 and an inner circumferential surface of the fixed base body 11H. As a result, the upper end of the moving shaft 20 is joined with the fixed base 11 so as to be movable in the up-down direction while being prohibited from rotation.

The connecting block 40 is formed into the shape of a generally square column extending in the front-rear direction, for example. The connecting block 40 is joined to the connecting flat portion 35 in the columnar portion 31 of the overlap feed limiting member 30 and fixed to the columnar portion 31 by a fixing bolt 44 extending in the up-down direction through the columnar portion 31 from the underside depression 34 side. The moving shaft 20 is butted with the front end of the connecting block 40 extending forward beyond the columnar portion 31, and a lower end adjusting bolt 42 (serving as a lower end stopper movement operating portion) passing through the connecting block 40 from the underside is threadingly engaged with the screw hole 21C formed in the center of the underside of the moving shaft 20, whereby the connecting block 40 is fixed to the lower end of the moving shaft 20.

The pressing washer 23B is fixed to the upper end of the moving shaft 20 by threadingly engaging the upper end adjusting bolt 23 having been inserted through a central though hole thereof from above with a screw hole 22N provided on the upper surface of the moving shaft 20. A sub compression coil spring 26 (serving as a sub elastic member) is provided around a part of the moving shaft 20 which protrudes from the upper surface 14B (the upper smaller-diameter shaft 22A) of the fixed base 11 (more specifically, the head cap 14). The sub compression coil spring 26 is compressively deformed between the pressing washer 23B and the fixed base 11. In the embodiment, a threading engagement mechanism between the upper end adjusting bolt 23A and the screw hole 22N of the moving shaft 20 serves as a deformation amount adjusting mechanism 22C. However, a threading engagement mechanism between the lower end adjusting bolt 42 and the screw hole 21C of the moving shaft 20 can also serve as the deformation amount adjusting mechanism in the embodiment.

The moving shaft 20 includes a part protruding downward from the fixed base 11, and a main compression coil spring 25 (serving as the main elastic member) is provided around the part of the moving shaft 20. The main compression coil spring 25 is inserted through the lower end through hole 13A of the bottom cap 13 and compressively deformed between the fixed base 11 and the connecting block 40. The connecting block 40 has an upper surface formed with a lower end bearing recess 41. The lower end bearing recess 41 has an innermost surface 41A with which the lower ends of the moving shaft 20 and compression coil spring 25 are butted. The fixed base 11 has a lower end surface in which an upper end bearing recess 12J is formed. The upper end bearing recess 12J has an innermost surface 12A with which the main compression coil spring 25 is butted.

Clamp rollers 39 are provided opposite to the stack loading section 70 with the overlap feed limiting member 30 being interposed therebetween as shown in FIG. 3. The clamp rollers 39 are pivotally supported on distal ends of a pair of lever arms 37 connected to the columnar bosses 36 of the overlap feed limiting member 30 respectively. The clamp rollers 39 are placed on the conveying surface of the guide belt 51 by self-weights thereby to be rotated in conjunction with the guide belt 51.

As the result of the above-described configuration, the main compression coil spring 25 imparts a main spring force to the moving shaft 20. The main spring force is directed in such a direction that the overlap feed limiting member 30 comes closer to the conveying surface of the conveying belt 63 (downward). On the other hand, the sub compression coil spring 26 imparts a sub spring force to the moving shaft 20. The sub spring force is directed in such a direction that the overlap feed limiting member 30 is departed from the conveying surface of the conveying belt 63 (upward). Furthermore, the moving shaft 20 is positioned at a lower end position within a movable range by the abutment of the lower end stoppers 12 and 21A in a non-hold state where no object is held between the overlap feed limiting member 30 and the conveying belt 63. As a result, the sub spring force is always equal to or smaller than the main spring force.

A predetermined nip gap GP2 is defined between the overlap feed limiting member 30 (the sliding contact ring 33) and the conveying surface of the conveying belt 63 when the moving shaft 20 is positioned at the lower end position within the movable range. The nip gap GP2 is set so as to be smaller than a thickness of the thinnest document (sheet S) of the documents S and B, for example. Furthermore, wear due to the friction between the sliding contact ring 33 and the conveying belt 63 can be prevented by the provision of the nip gap GP2. When no nip gap GP2 is provided in the non-hold state, the overlap feed limiting member 30 may be a rotating member rotated in conjunction with the conveying belt 63, or the conveying belt 63 may be automatically stopped immediately upon detection of empty feed.

Furthermore, a rise allowing gap GP1 is defined between the underside 13B of the bottom cap 13 and the upper surface of the connecting block 40 while the moving shaft 20 is positioned at a lower end position within the movable range. The overlap feed limiting member 30 is upwardly movable within a range of the rise allowing gap GP1. In the embodiment, the size of the rise allowing gap GP1 is changeable by threadingly engaging the bottom cap 13 with the fixed base 11. More specifically, the rise allowing gap GP1 can be rendered larger by increasing an amount of threading engagement between the bottom cap 13 and the fixed base 11, thereby displacing the underside 13B of the bottom cap 13 upward. The bottom cap 13 corresponds to an upper end stopper and the bottom cap 13 itself serves as an upper end stopper movement operating portion.

When plural documents S, B placed on the stack loading section 70 are all sheets S, for example, the bottom cap 13 is threadingly engaged to set the rise allowing gap GP1 in order that the nip gap GP2 between the overlap feed limiting member 30 and the conveying belt 63 at the abutment position where the connecting block 40 abuts against the underside 13B of the bottom cap 13 becomes equal to or larger than the thickness of a single sheet S and smaller than the thickness of two sheets S. Consequently, two or more sheets S in a stacked state can reliably be prevented from passing between the overlap feed limiting member 30 and the conveying belt 63.

Similarly, when plural documents S, B placed on the stack loading section 70 are all booklets B, the bottom cap 13 is threadingly engaged to set the rise allowing gap GP1 in order that the nip gap GP2 at the abutment position becomes equal to or larger than the thickness of a single booklet B and smaller than the thickness of two booklets B. Consequently, two or more booklets B in a stacked state can reliably be prevented from passing between the overlap feed limiting member 30 and the conveying belt 63.

Furthermore, when plural documents S, B placed on the stack loading section 70 are a mixture of sheets S and booklets B, the bottom cap 13 is threadingly engaged to set the rise allowing gap GP1 in order that the nip gap GP2 at the abutment position becomes equal to or larger than the thickness of a single booklet B and smaller than the thickness of a single booklet B and a single sheet S in a stacked state. Consequently, two or more booklets B in a stacked state or a single booklet B and a single sheet S in the stacked state can reliably be prevented from passing between the overlap feed limiting member 30 and the conveying belt 63.

Amounts of elastic deformation of the main and sub compression coil springs 25 and 26 can be changed by moving the pressing washer 23B in the up-down direction by the pivotal movement of the upper end adjusting bolt 23A in the feeding apparatus 100 according to the embodiment. More specifically, the pressing washer 23B and the connecting block 40 come closer to each other as the upper end adjusting bolt 23A is tightened up, whereupon amounts of elastic deformation of the main and sub compression coil springs 25 and 26 are increased. The sub spring force of the sub compression coil spring 26 is directed opposite to the main spring force of the main compression coil spring 25 as described above. Accordingly, when an amount of elastic deformation of the main compression coil spring 25 is increased or decreased by the deformation amount adjusting mechanism 22C, an amount of elastic deformation of the sub compression coil spring 26 can be increased or decreased accordingly, whereupon increments and decrements of the main and sub spring forces in the non-hold state are canceled by each other. As a result, a composite spring force (that is, a resisting force by which the document S, B enters between the limiting member 30 and the conveying belt 63) at the time when the main and sub compression coil springs 25 and 26 are elastically deformed from the state where the main and sub spring forces are balanced with each other becomes the same irrespective of amounts of elastic deformation of the main and sub compression coil springs 25 and 26. On the other hand, a position (hereinafter, referred to as a "spring force balanced position") of the overlap feed limiting member 30 in the case where the main and sub spring forces are equalized and balanced is changed when amounts of elastic deformation are changed by the deformation amount adjusting mechanism 22C. More specifically, according to the embodiment, irrespective of the spring force balanced position of the overlap feed limiting member 30 changed by the deformation amount adjusting mechanism 22C, a change in the composite force of the main and sub spring forces on the occasion where the overlap feed limiting member 30 is moved from the spring force balanced position can be rendered constant.

Figure 9:
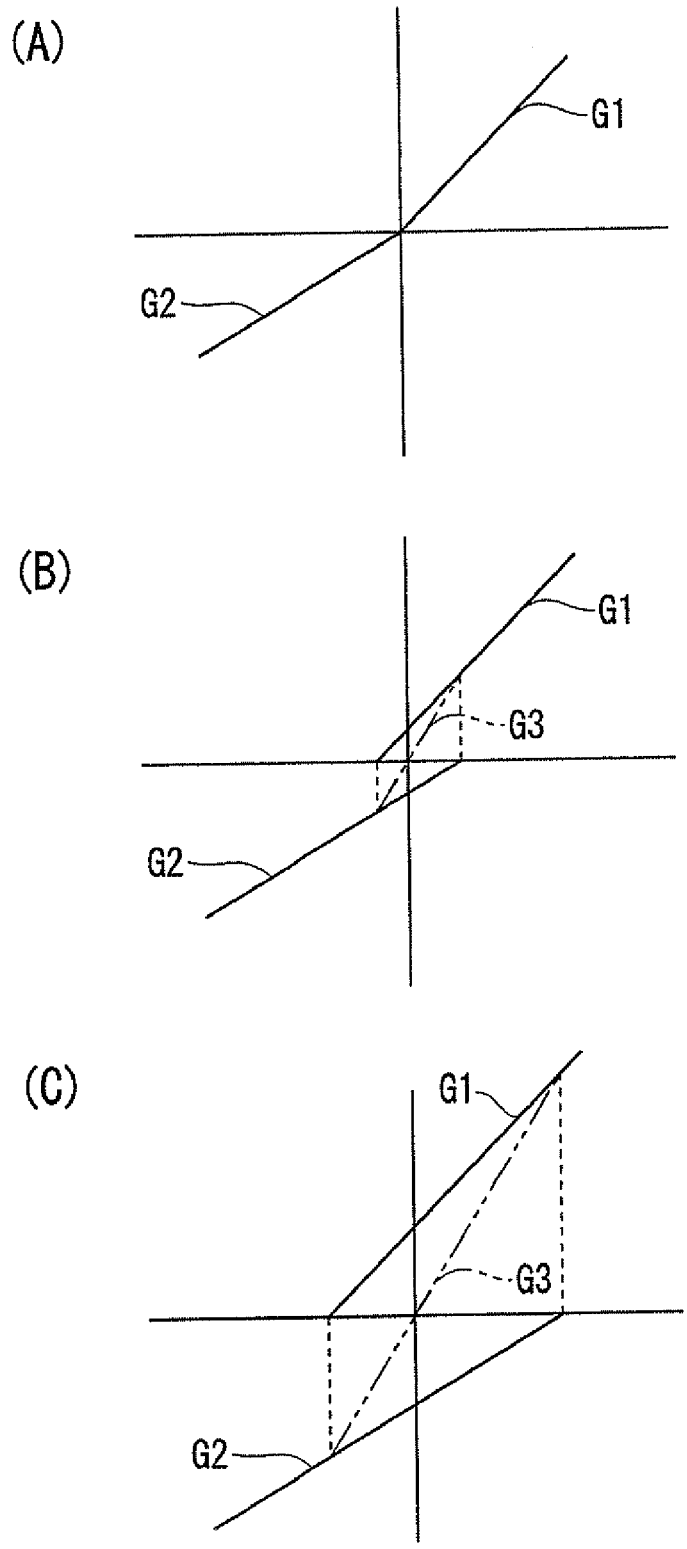
FIG. 9 is a graph showing the relationship between a spring force and an amount of elastic deformation of compression coil springs.

FIG. 9 is a graphical representation of the above-described principle. An axis of ordinate of the graph indicates a spring force of a spring, and an axis of abscissa indicates an amount of elastic deformation by the threading engagement of the upper end adjusting bolt 23A. Reference symbol G1 in FIGS. 9A to 9C is a line of a spring force of the main compression coil spring 25, and reference symbol G2 is a line of a spring force of the sub compression coil spring 26. Reference symbol G3 in FIGS. 9B and 9C is a line of a composite spring force of the main and sub compression coil springs 25 and 26. These lines exemplify the case where the main and sub compression coil springs 25 and 26 have different lengths and different spring stiffness.

FIG. 9A shows a spring characteristic of a composite spring in the state where the main and sub compression coil springs 25 and 26 are assembled together without elastic deformation. When the upper end adjusting bolt 23A is tightened up from that state, line G1 indicative of the main spring force of the main compression coil spring 25 and line G2 indicative of the sub spring force of the sub compression coil spring 26 are parallely shifted in the direction of abscissa axis (amount of elastic deformation) so as to be departed from each other. In this case, line G3 of composite spring force of the main and sub compression coil springs 25 and 26 can be obtained by subtracting the sub spring force of the sub compression coil spring 26 from the main spring force of the main compression coil spring 25. Furthermore, FIG. 9C shows the state where the upper end adjusting bolt 23A is further tightened up from the state of FIG. 9B. As understood from the comparison between FIGS. 9B and 9C, the gradient and intersection with the ordinate axis of line G3 are not varied depending upon an amount of tightening of the upper end adjusting bolt 23A. This principle can also be applied to an occasion when the main and sub compression coil springs 25 and 26 have the same length and the same spring stiffness.

Based on the above-described principle, the resisting force by which the document S, B is caused to enter between the overlap feed limiting member 30 and the rotating member can be adjusted so as not to be changed in the feeding apparatus 100 of the embodiment even when the spring force balanced position of the overlap feed limiting member 30 is moved to a relatively lower position for relatively thinner documents S, B by the deformation amount adjusting mechanism 22C or even when the spring force balanced position of the overlap feed limiting member 30 is moved to a relatively higher position for relatively thicker documents S, B by the deformation amount adjusting mechanism 22C. Furthermore, the resisting force by which the document S, B is caused to enter between the overlap feed limiting member 30 and the rotating member can be changed suitably by changing amounts of elastic deformation of the main and sub springs 25 and 26 with respect to documents S, B with the same thickness by the deformation amount adjusting mechanism 22C. More specifically, according to the feeding apparatus 100 of the embodiment, an adjustable range to feed the documents S, B one by one according to the thicknesses of the documents S, B can be rendered wider than the conventional apparatus. Furthermore, it is a matter of course that the composite spring force becomes zero at a position where the spring forces of the main and sub springs 25 and 26 are balanced. Accordingly, when no lower end stoppers 12, 21A are provided, an initial spring force in the case of lifting the overlap feed limiting member 30 is normally increased gradually from zero whatever position the overlap feed limiting member 30 is changed to by the operation of the upper end adjusting bolt 23A. More specifically, an initial resisting force on the occasion where the document S, B enters between the overlap feed limiting member 30 and the conveying belt 63 can be rendered smaller by eliminating the lower end stopper 12, 21A. On the other hand, when the lower end stopper 12, 21A is provided as in the embodiment, the overlap feed limiting member 30 can be maintained at an upwardly lifted position from the position where the spring forces of the main and sub springs 25 and 26 are equibrated. Consequently, the initial resisting force on the occasion when the document S, B enters between the overlap feed limiting member 30 and the conveying belt 63 can be rendered larger.

The operation of the embodiment will now be described. When the conveying belt 63 is driven with the documents S, B being placed on the stack loading section 70, the conveying surface of the belt 63 and the underside of the lowermost document S, B on the stack loading section 70 are brought into frictional contact with each other such that the lowermost document S, B is drawn frontward out of the stack loading section 70 through the document outlet 72. The document S, B drawn from the stack loading section 70 thrusts into the nip gap GP2 between the overlap feed limiting member 30 and the conveying belt 63, whereupon a plurality of documents S, B in a stacked state are prevented from passing.

In the feeding apparatus 100 of the embodiment, the moving base 29 supporting the overlap feed limiting member 30 is supported by the fixed base 11 so as to be movable in the up-down direction, and the main and sub compression coil springs 25 and 26 are provided between the moving and fixed bases 29 and 11. The main compression coil spring 25 imparts to the moving base 29 the main spring force to press the overlap feed limiting member 30 against the document S, B. The sub compression coil spring 26 imparts to the moving base 29 the sub spring force that is directed opposite to the main spring force. Accordingly, when the overlap feed limiting member 30 is thrust upward by the document S, B, the differential spring force obtained by subtracting the sub spring force from the main spring force is applied to the document S, B. The differential spring force acts as the resisting force for the document S, B to enter between the overlap feed limiting member 30 and the conveying belt 63, thereby allowing the documents S, B to pass one by one and preventing the documents S, B from passing in a stacked state.

In more detail, the document S, B right above the lowermost document S, B sometimes trails due to a frictional force, static electricity or the like caused between the documents S, B such that the documents S, B are fed forward in a stacked state toward the nip gap GF2 between the overlap feed limiting member 30 and the conveying belt 63. However, since the frictional force, static electricity or the like is much smaller than a frictional force between the conveying belt 63 and the document S, B, the lowermost document S, B passes through between the conveying belt 63 and the overlap feed limiting member 30 while uplifting the overlap feed limiting member 30. The document S, B located right above the lowermost document S, B abuts against the outer periphery of the overlap feed limiting member 30 thereby to be prevented from further forward movement. More specifically, two or more documents S, B can be prevented from fed in a stacked state, and that is, overlap feed of documents S, B can be prevented.

According to the feeding apparatus 100, the adjustable range depending on the thickness of the document S, B is rendered wider than the conventional feeding apparatus, whereby the overlap feed of the documents S, B can be prevented more reliably than the conventional apparatus. More specifically, as conceptually shown in FIG. 21, in order that only the object A to be fed may pass between the overlap feed limiting member 30 and the conveying belt 63 while the next object B to be fed is blocked by the overlap feed limiting member 30, the following relational expression, $F1>F3>F2$, needs to be true where F1 designates a frictional resistance between the conveying belt 63 (the rotating member) and the object A on the conveying belt 63, F2 designates a frictional resistance between the object A to be fed and the next object B, and F3 designates a frictional resistance between the object A to be fed and the overlap feed limiting member 30. Since an adjustable range according to the thickness of an object to be conveyed is narrow in the conventional feeding apparatus, the above relational expression is difficult or impossible to be met. However, since the adjustable range according to the thickness of the object to be conveyed is wider in the feeding apparatus 100 in accordance with the embodiment, the adjustment which meets the above relational expression can be realized, whereupon overlap feed of the documents S, B can be prevented more reliably than the conventional feeding apparatus. Furthermore, the adjusting work is easy since the deformation amount adjusting mechanism 22C to execute adjustment according to the thicknesses of the documents S, B is disposed on the upper end of the moving shaft 20. Additionally, the feeding apparatus 100 includes the lower end adjusting bolt 42 changing the position of the connecting block 40 abutting against the main compression coil spring 25, as well as the upper end adjusting bolt 23A. As a result, the degree of freedom in the adjustment can be increased.

Subsequently, a system 220 for sorting forwarding documents provided with the above-described feeding apparatus 100 will be described. The sorting system 200 collects up documents S, B slidingly fed one by one from the feeding apparatus 100 into a set of forwarding documents based on an identifier printed on the document S, B such as characters or patterns. The sorting system 200 distinguishes and sequentially feeds the forwarding document sets one set by one set to a known online inserter 210 (see FIG. 7).

The online inserter 210 includes a belt conveyor 211 conveying the forwarding document sets distinctively from one set to another. A necessary accompanying document is added to each forwarding document set in the midst of the conveying passage, as appropriate. After having passed through the online inserter 210, the forwarding document sets are enclosed in envelopes and then sealed by an enclosing apparatus 220 respectively.

Figure 6:
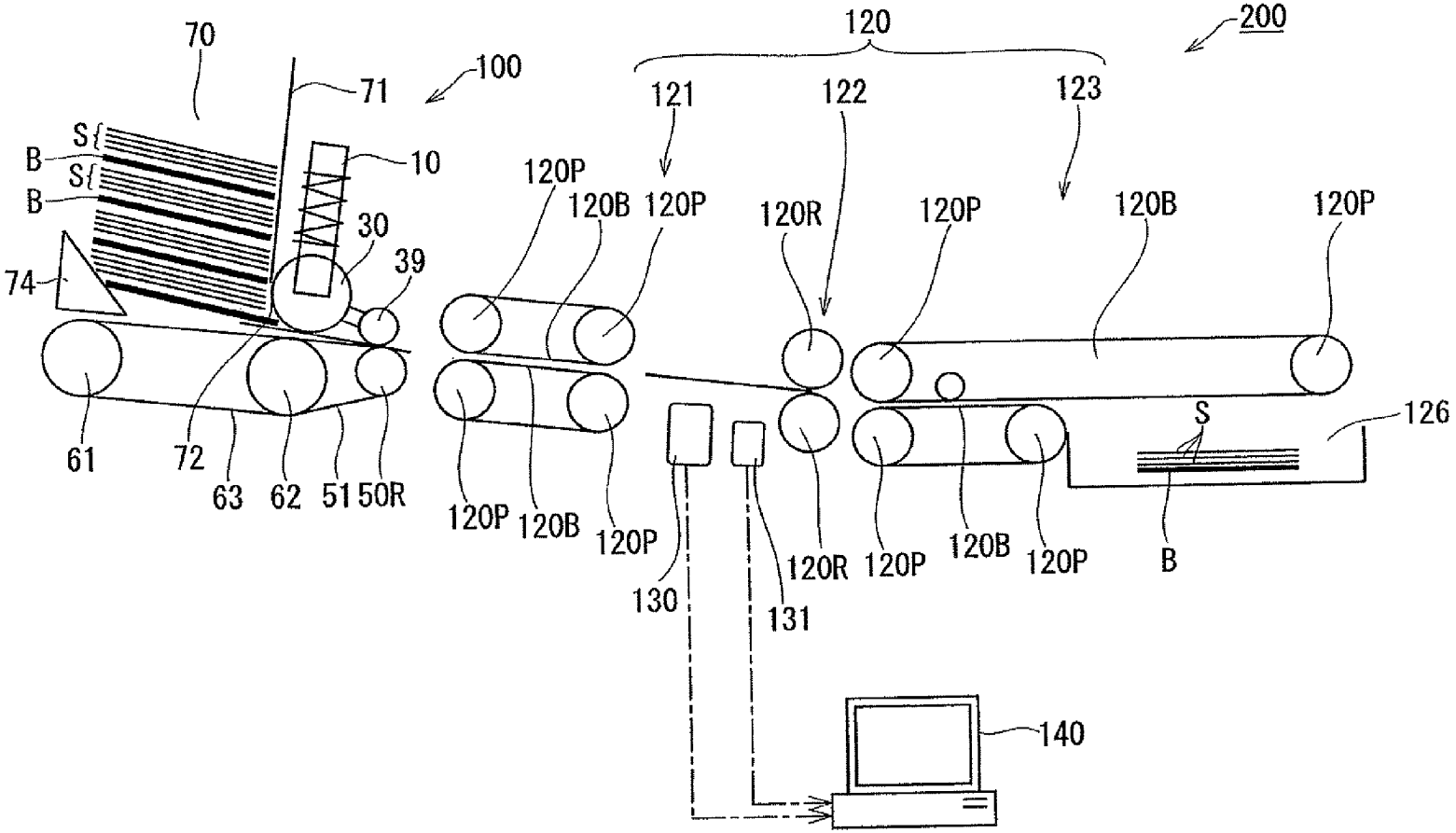
FIG. 6 is a conceptual diagram of the system for sorting forwarding documents and feeding apparatus.
Figure 7:
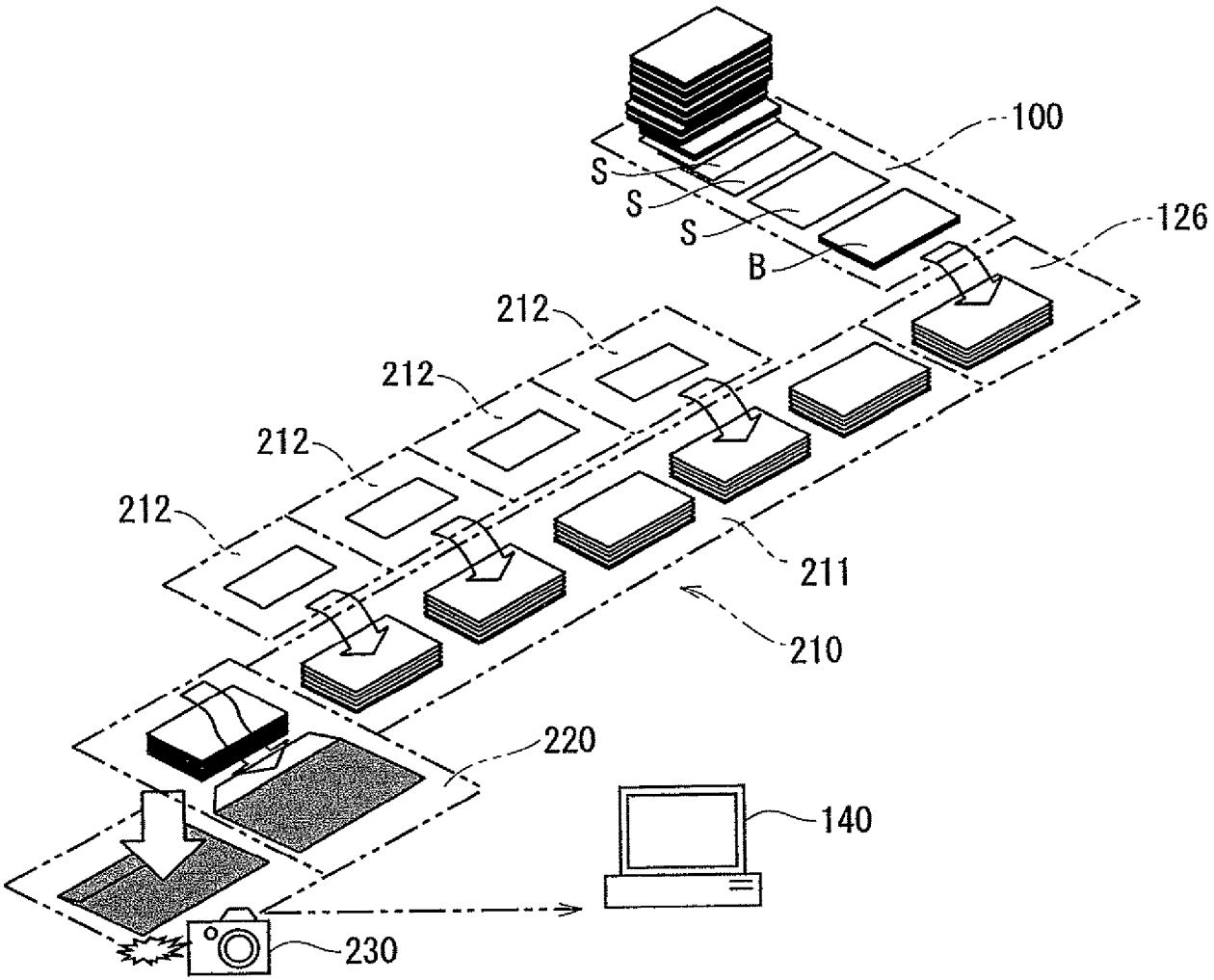
FIG. 7 is a conceptual diagram of an online inserter.

The sorting system 200 includes a relay conveyance unit 120 provided between the feeding apparatus 100 and the belt conveyor 211 of the online inserter 210. FIG. 6 shows a simplified form of the sorting system 200 as shown in FIG. 2. As shown, the relay conveyance unit 120 is disposed on the extension in the direction of sliding feed by the feeding apparatus 100. The relay conveyance unit 120 includes first to third relay conveying sections 121 to 123 sequentially arranged from the side near the feeding apparatus 100. The documents S, B are transferred between adjacent relay conveying units thereby to be fed one by one.

The first and third relay conveying sections 121 and 123 serve as a belt pinching conveying mechanism. More specifically, the first and third relay conveying sections 121 and 123 include upper and lower pairs of pinch belts 1203 stretched between a pair of pulleys 120P and rotatingly running. The document S, B is pinched between the pinch belts 120B thereby to be conveyed. The second relay conveying section 122 serves as a roller pinching conveying mechanism. More specifically, the document S, B is pinched between a pair of pinch rollers 120R disposed opposite to each other in the up-down direction thereby to be drawn from the first relay conveying portion 121 and to be fed toward the third relay conveying section 123. The first and second relay conveying sections 121 and 122 share a second servomotor 124 (see FIG. 2) as a drive source and feed the document S, B at a higher speed than the feeding apparatus 100 having the first servomotor 66 as a drive source thereof. Furthermore, the third relay conveying section 123 has a third servomotor 125 (see FIG. 2) differing from the first and second servomotors 66 and 124 as a drive source thereof and feeds the documents S, B at a higher speed than the first and second relay conveying sections 121 and 122.

A bar-code reader 130 and a mark reader 131 for reading a bar-code BC and a first page mark FM as an identifier printed on the document S, B are provided between the first and second relay conveying sections 121 and 122 as shown in FIG. 6.

Figure 8:
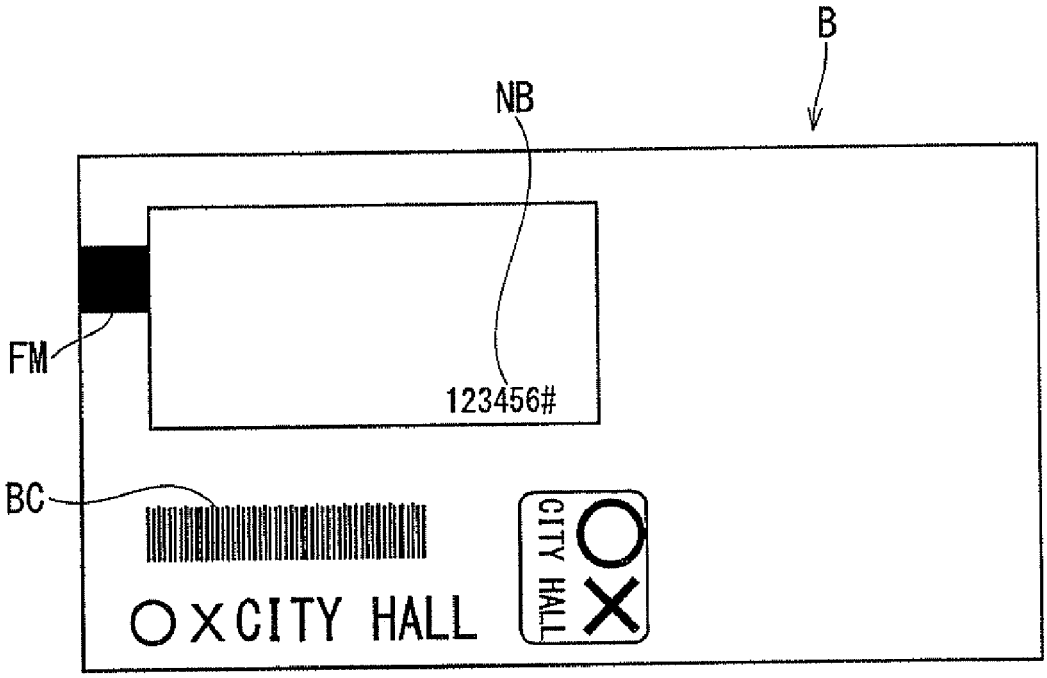
FIG. 8 is a conceptual diagram of a booklet.

The operation of the sorting system 200 will now be described as taking an example where a plurality of sets of forwarding documents are placed on the stack loading section 70, each set includes a single booklet B and an arbitrary number of sheets S, and the bar-code BC and first page mark FM are printed only on the booklets B as shown in FIG. 8. Out of information converted to bar-codes, a readable character NB indicative of a serial number allotted to each set of forwarding documents in the form of a combination of alphanumeral and sign is provided on a predetermined position of each booklet B.

The mark reader 131 serves as a determining sensor and determines existence or nonexistence of the first page mark while each document S, B is transferred from the first relay conveying section 121 to the second relay conveying section 122. When no first page mark FM is detected, the mark reader 131 determines that the document S, B is not a first document of the forwarding document set, that is, is not a booklet B (is a sheet S). In this case, the sheet S is fed to the second and third relay conveying sections 122 and 123 in turn and further to a collector 126 that is on standby in front of the third relay conveying section 123. The sheets S are continuously fed to the collector 126 until the first page mark FM is detected.

When the first page mark FM is detected, the mark reader 131 determines that the document S, B is a first document of the subsequent forwarding document set, that is, a booklet B. In this case, the feeding apparatus 100 and the first and second relay conveying sections 121 and 122 are stopped while the front end of the booklet B on which the first page mark FM is printed is pinched between the pinch rollers 120R of the second relay conveying section 122. In the stopped state, the bar-code reader 130 reads the bar-code BC printed on the booklet B. The information read from the bar-code BC is output to a control computer 140. Based on the serial number, the control computer 140 executes a serial number check. More specifically, the control computer 140 checks whether forwarding document sets are being fed to the collector 126 sequentially one set by one set.

Furthermore, while the feeding apparatus 100 and the first and second relay conveying sections 121 and 122 are stopped, the third relay conveying section 123 conveys to the collector 126 the sheet S (the last sheet S of the previous set of forwarding documents) located immediately before the booklet B pinched by the second relay conveying section 122.

Consequently, one set of forwarding documents is collected to the collector 126. More specifically, the forwarding documents are collected up in a state where the booklet B is located at the lowest and any number of sheets S is stacked on the booklet B. A thickness of the set of forwarding documents is measured, and then the set of forwarding documents is transferred from the collector 126 to the belt conveyor 211 of the online inserter 210. An aggregating unit thus comprises the relay conveyance unit 120, the bar-code reader 130, the mark reader 131, the collector 126 and the control computer 140.

Necessary accompanying documents are optionally added to the forwarding document set by inserters 212 in the course of conveyance by the belt conveyor 211. The inserters 212 are adapted to add different accompanying documents. Based on information read from the bar-code BC, the control computer 140 instructs each inserter 212 as to which accompanying document should be added to each forwarding document set.

After one set of forwarding documents is transferred to the online inserter 210, the feeding apparatus 100 and the relay conveyance unit 120 restart so that a subsequent set of forwarding documents is collected to the collector 126.

The enclosing apparatus 220 is provided on a terminal end of the belt conveyor 211 of the online inserter 210. One set of forwarding documents and accompanying documents are inserted into an envelope together and the envelope is sealed.

Thereafter, a readable character NB affixed to the booklet B is read by a camera 230. Based on the read character NB, the control computer 140 executes a sequential number check and records the sequential number together with the current time and other information (executes log management).

Furthermore, a set of forwarding document to be enclosed in an envelope and the number and type of accompanying documents are determined based on the readable character NB. A theoretical thickness obtained from the aforesaid determination and an actually measured thickness are compared with each other. Existence or non-existence of error enclosure is determined regarding each envelope depending upon whether these thicknesses are in agreement with each other within a predetermined range of error.

Figure 10:
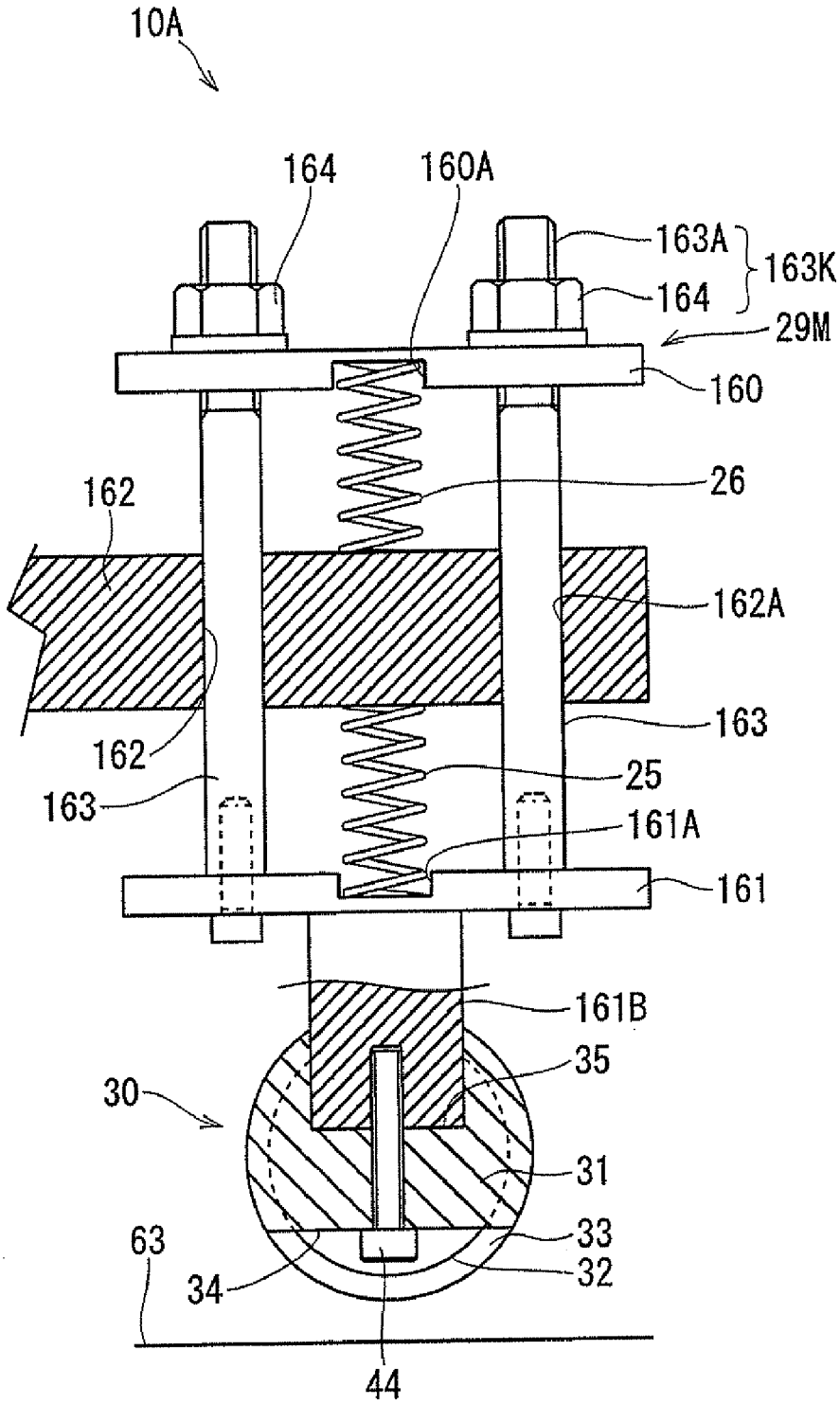
FIG. 10 is a side sectional view of a linear motion holding mechanism in accordance with a second embodiment.

FIG. 10 illustrates a second embodiment. The second embodiment differs from the first embodiment in structure of a linear motion support mechanism 10A. The linear motion support mechanism 10A in the second embodiment includes a fixed base 162 which is fixed to the front surface of the stack loading section 70 via the component mount 80 (see FIG. 3) in the same manner as the fixed base 11 in the first embodiment (fixed bases in third to ninth embodiments are fixed in the same manner as described above). The fixed base 162 has a pair of shaft insertion holes 162A which are formed so as to pass therethrough in the up-down direction. A pair of moving shafts 163 are inserted through the shaft insertion holes 162A respectively. The moving shafts 163 have upper ends which are connected by an upper spring abutment plate 160 corresponding to an upper end pressurizing member and lower ends which are connected by a lower spring abutment plate 161 corresponding to a lower end pressurizing member, respectively.

The lower spring abutment plate 161 is formed into, for example, the shape of a horizontally long flat plate and has both lateral ends fixed to the moving shafts 163 by bolts passing through the lower spring abutment plate 161 from below. A recess 161A is formed in the central part of the upper surface of the abutment plate 161 between the moving shafts 163. A main compression coil spring 25 is assembled between an innermost surface of the recess 161A and the underside of the fixed base 162 in a compressively deformed state. Furthermore, a square columnar connection 161B hangs down from the underside of the abutment plate 161. The connection 161B is fixed to the overlap feed limiting member 30 with a lower end surface thereof being joined to a connecting flat part 35 of the columnar portion 31.

An upper spring abutment plate 160 is also formed into the shape of a horizontally long flat plate in the same manner as the lower spring abutment plate 161 and has both lateral ends through which the moving shafts 163 extend in the up-down direction. The moving shafts 163 have upper ends formed with helical portions 163A with which nuts 164 are threadingly engaged thereby to be in abutment with an upper surface of the upper spring abutment plate 160, respectively. The helical portions 163A and the nuts 164 constitute a deformation amount adjusting mechanism 163K. Furthermore, a recess 160A is formed in the central part of the underside of the upper spring abutment plate 160 between the moving shafts 163. A sub compression coil spring 26 is provided between an innermost surface of the recess 160A and the upper surface of the fixed base 162 in a compressively deformed state. The upper spring abutment plate 160 is positioned relative to the moving shafts 163 by the upthrust of the upper abutment plate 160 by the sub spring 26 and the abutment with the nuts 164. As a result, the position of the lower spring abutment plate 161 in the moving shafts 63 can be changed by the threading engagement of the deformation amount adjusting mechanism 163K. Furthermore, a moving base 29M is composed of the upper and lower spring abutment plates 160 and 161, the moving shafts 163, the nuts 164 and the connection 161B. The other configurations of the feeding apparatus of the second embodiment are the same as those of the first embodiment, and the overlapping description will be omitted. The configuration of the second embodiment allows for an adjustment according to the thicknesses of the documents S, B by the operation of the deformation amount adjusting mechanism 163 in the same manner as the first embodiment. This can broaden the adjustable range for feeding the documents S, B one by one as compared with the conventional configuration. A female thread hole may be formed in a surface of the fixed base 162 opposed to the upper abutment plate 160, and a lower end stopper bolt serving as the lower end stopper and the lower end stopper movement operating portion may be threadingly engaged with the female thread hole in the second embodiment. As a result, when the moving base 29M is moved lower, the upper abutment plate 160 abuts on the lower end stopper bolt thereby to prevent the moving base 29M from being moved downward from the abutment position. Furthermore, for example, a female thread hole may be formed in a surface of the fixed base 162 opposed to the lower abutment plate 161, and an upper end stopper bolt serving as the upper end stopper and the upper end stopper movement operating portion may be threadingly engaged with the female thread hole. As a result, when the moving base 29M is moved upward, the lower abutment plate 161 abuts on the upper end stopper bolt thereby to prevent the moving base 29M from being moved upward from the abutment position, in the same manner as in the first embodiment.

Figure 11:
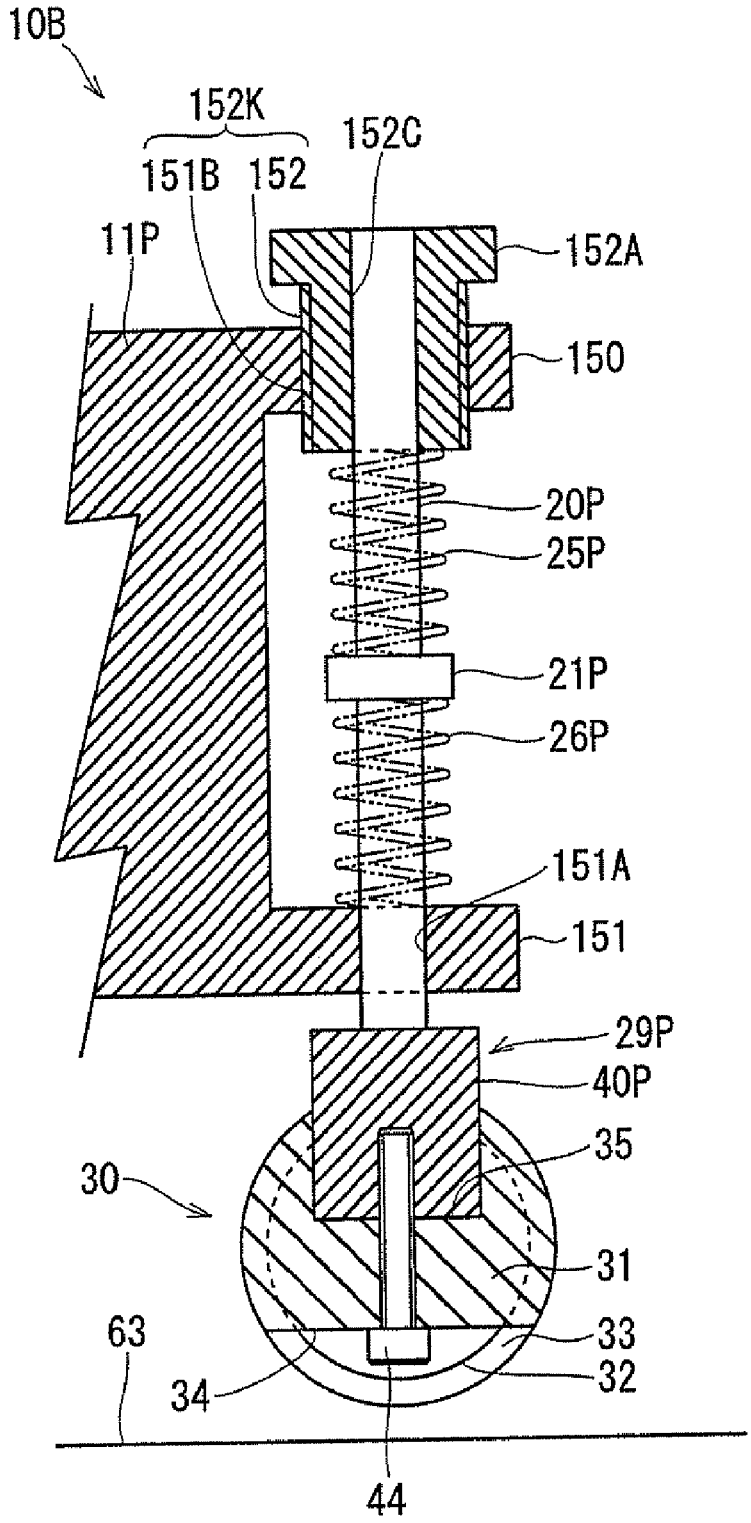
FIG. 11 is a side sectional view of a linear motion holding mechanism in accordance with a third embodiment.

FIG. 11 illustrates a third embodiment. The third embodiment differs from the first and second embodiments in structure of a linear motion support mechanism 10B. The linear motion support mechanism 10B in the third embodiment includes a fixed base 11P provided with upper and lower shaft support walls 150 and 151 opposed to each other in the up-down direction. The upper shaft support wall 150 has a female screw hole 151B formed so as to extend therethrough in the up-down direction. An adjusting nut 152 threadingly engaged with the female screw hole 151B constitutes a part of the upper shaft support wall 150, and the adjusting nut 152 and the female screw hole 151B constitute a deformation amount adjusting mechanism 152K.

The moving shaft 20P has both ends which are inserted through the shaft insertion holes 151A and 152C and supported so as to be movable in the up-down direction in the third embodiment. Furthermore, the moving shaft 20P includes an axial middle portion from which a circular plate-shaped middle abutment 21P juts sideways. The abutment 21P is movable in the up-down direction together with the moving shaft 20P and is opposed to the upper and lower shaft support walls 150 and 151 in the up-down direction. A main compression coil spring 25P is mounted between the middle abutment 212 and the upper shaft support wall 150 in a compressively deformed state. A sub compression coil spring 26P is mounted between the middle abutment 21P and the lower shaft support wall 151 in a compressively deformed state. The other configurations of the feeding apparatus of the third embodiment are the same as those of the first embodiment, and the overlapping description will be omitted. The configuration of the third embodiment also allows for an adjustment according to the thicknesses of the documents S, B by operation of the deformation amount adjusting mechanism 152K in the same manner as the first and second embodiments. This can broaden the adjustable range for feeding the documents S, B one by one, as compared with the conventional configuration.

In the above-described configuration, the main compression coil spring 25P and/or sub compression coil spring 26P may be held between the upper shaft support wall 150 and the middle abutment 21P or between the middle abutment 21P and the lower shaft support wall 151 without being inserted through the moving shaft 20P in the same manner as in the second embodiment. This modification can also be applied to the following fourth embodiment. Furthermore, the middle abutment 21P may jut sideways, and a female screw hole may be formed in a surface of the lower shaft support wall 151 opposed to the middle abutment 21P. A lower end stopper bolt serving as the lower end stopper and as the lower end stopper movement operating portion may be threadingly engaged with the female screw hole. Furthermore, a female screw hole may be formed in a surface of the upper shaft support wall 150 opposed to the middle abutment 21P, and the upper end stopper bolt serving as the upper end stopper and the upper end stopper movement operating portion may be threadingly engaged with the female screw hole.

Figure 12:
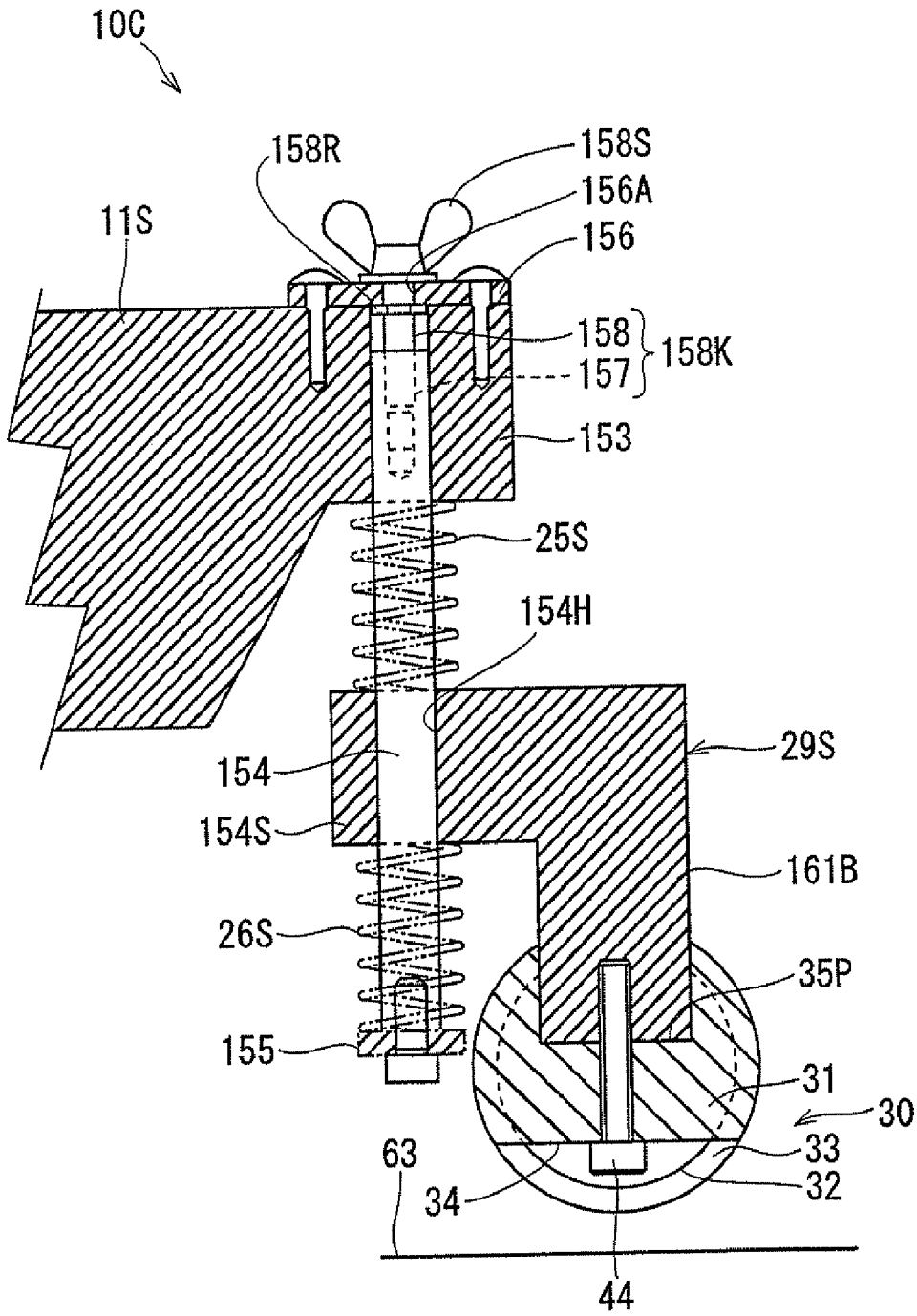
FIG. 12 is a side sectional view of a linear motion holding mechanism in accordance with a fourth embodiment.

FIG. 12 illustrates a fourth embodiment. The fourth embodiment differs from the first to third embodiments in structure of a linear motion support mechanism 10C. The linear motion support mechanism 10C in the fourth embodiment includes a fixed base 11S provided with an upper end elastic member bearing portion 153 protruding forward (to the side departed away from the component mount 80 (see FIG. 3). The bearing portion 153 is formed with a vertical through hole 153A. Furthermore, a bolt support plate 156 is fixed to an upper surface of the fixed base 115. The bolt support plate 156 has a through hole 156A formed so as to be coaxial with the through hole 153A and so as to have a smaller diameter than the upper end elastic member bearing section 153. An adjusting screw 158 is supported on the bolt support plate 156 so as to be rotatable and immovable in the up-down direction. More specifically, the adjusting screw 158 is provided with a knob operating portion 158S on an upper end thereof and an engagement groove near the upper end. An E-shaped ring 158R is engaged with the engagement groove while the knob operating portion 158S is in abutment with an edge of the through hole 156A on the upper surface of the bolt support plate 156, so that the E-shaped ring 158R is applied to an edge of the through hole 156A on the underside of the bolt support plate 156, whereby the adjusting screw 158 is supported on the bolt support plate 156 so as to be rotatable and immovable in the up-down direction.

The through hole 153A is inserted with an upper end of a fixed shaft 154. A female screw hole 157 is formed in the central upper end of the fixed shaft 154. The adjusting screw 158 is threadingly engaged with the female screw hole 157. Furthermore, the through hole 153A has a noncircular section or is provided with a vertical groove (not shown). On the other hand, the fixed shaft 154 has an upper end having a noncircular section corresponding to the through hole 153A. On the other hand, the upper end of the fixed shaft 154 has a noncircular section corresponding to the through hole 153A or is provided with a protrusion (not shown) engaged with the vertical groove of the through hole 153A. As a result, the fixed shaft 154 is inserted through the through hole 153A so as to be linearly movable and non-rotatable. The fixed shaft 154 is moved in the up-down direction relative to the fixed base 115 by a threading engagement of a deformation amount adjusting mechanism 158K composed of the adjusting screw 158 and the female screw hole 157. The fixed shaft 154 extends downward from the upper end elastic member bearing portion 153 and has a lower end to which a circular plate-shaped lower end elastic member bearing portion 155 is fixed by a bolt.

A moving base 29S in the fourth embodiment includes a connection 161B fixed to the overlap feed limiting member 30 and a vertical slide 154S protruding rearward from a connection 161B. The vertical slide 154S has a shaft insertion hole 154H formed therethrough in the up-down direction. The fixed shaft 154 has an axial middle portion which is inserted through the shaft insertion hole 154H so as to be linearly movable. Furthermore, a main compression coil spring 25S is provided about the fixed shaft 154 between the upper end elastic member bearing portion 153 and the vertical slide 154S in a compressed state. Furthermore, a sub compression coil spring 26S is provided about the fixed shaft 154 between the lower end elastic member bearing portion 155 and the vertical slide 154S. The fourth embodiment can also realize an adjustment according to the thicknesses of the documents S, B by the operation of the deformation amount adjusting mechanism 158K in the same manner as the first to third embodiments. This can broaden the adjustable range for feeding the documents S, B one by one, as compared with the conventional configuration. In the fourth embodiment, for example, the lower end elastic member bearing portion 155 and the vertical slide 154S may jut sideways. A female screw hole may be formed in a surface of the vertical slide 154S opposed to the lower end elastic member bearing portion 155, and a lower end stopper bolt serving as the lower end stopper and the lower end stopper movement operating portion may be threadingly engaged with the female screw hole. A female screw hole may be formed in a surface of the upper end elastic member bearing portion 153 opposed to the vertical slide 154S, and an upper end stopper bolt serving as the upper end stopper and the upper end stopper movement operating portion may be threadingly engaged with the female screw hole.

Figure 13:
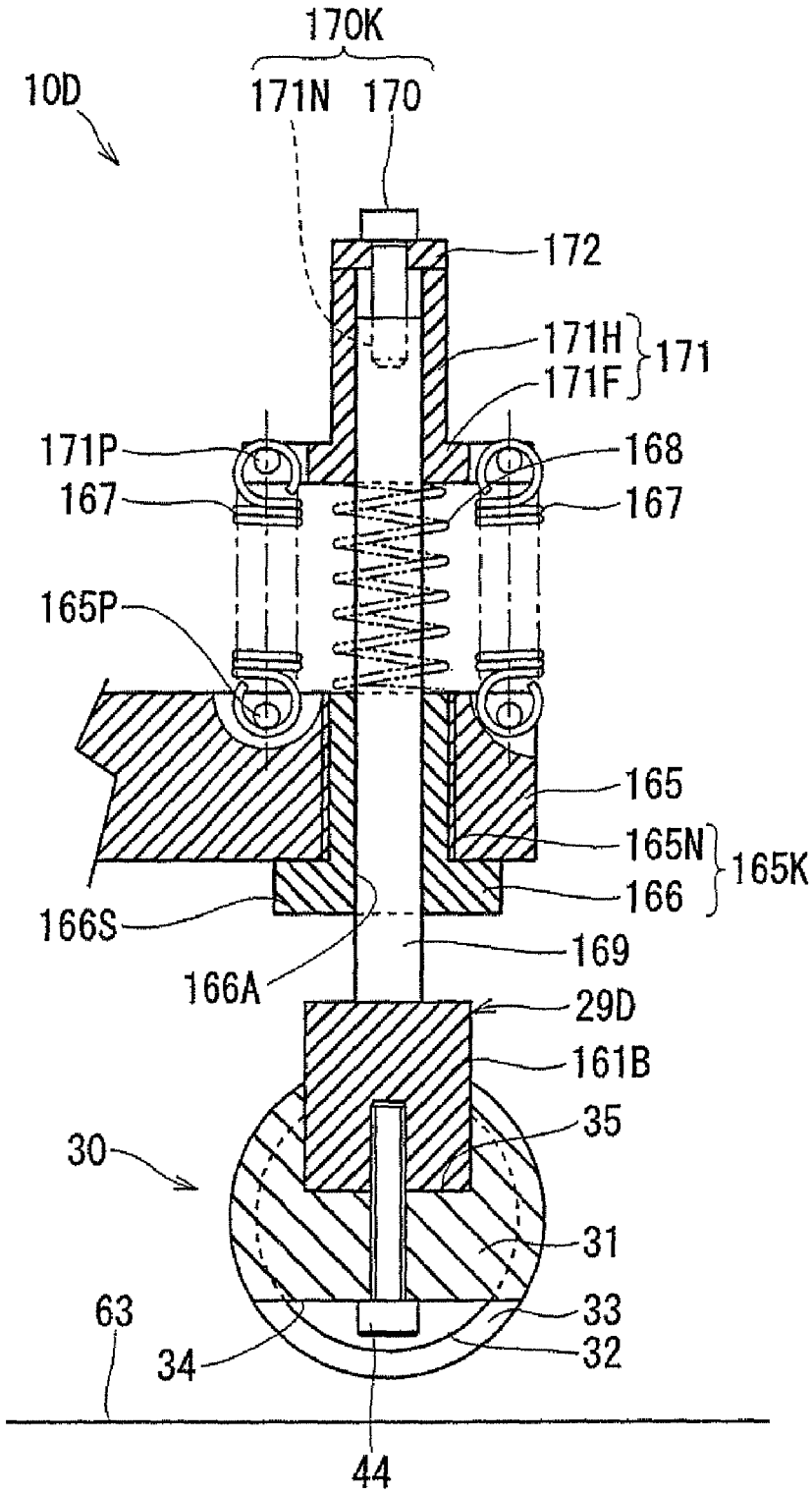
FIG. 13 is a side sectional view of a linear motion holding mechanism in accordance with a fifth embodiment.

FIG. 13 illustrates a fifth embodiment. The fifth embodiment differs from the first to fourth embodiments in structure of a linear motion support mechanism 10D. The linear motion support mechanism 10D of the fifth embodiment includes a fixed base 165 provided with a female screw hole 165N formed so as to extend in the up-down direction. An adjusting bolt 166 is threadingly engaged with the female screw hole 165N from below. The adjusting bolt 166 constitutes a part of the fixed base 165. Furthermore, the female screw hole 165N and the adjusting bolt 166 constitute a deformation amount adjusting mechanism 165K.

The adjusting bolt 166 has a lower end on which an operating portion 166S having, for example, a hexagonal planar shape is provided. The adjusting bolt 166 further has a central portion through which a shaft insertion hole 166A is formed. A moving shaft 169 is inserted through the shaft insertion hole 166A. The moving shaft 169 has a lower end provided with a connection 161B, and the overlap feed limiting member 30 is fixed to the lower end surface.

The moving shaft 169 has an upper end to which a moving abutment member 171 is fixed. The moving abutment member 171 is structured so that a flange 171F juts sideways from a lower end of a cylindrical portion 171H. Furthermore, the cylindrical portion 171H has an upper end which is closed by a washer 172, and an upper end bolt 170 is inserted from above through a through hole passing through the center of the washer 172. The upper end bolt 170 is threadingly engaged with a female screw hole 171N formed in a central upper end of the moving shaft 169. A sub compression coil spring 168 serving as the sub elastic member is provided about the moving shaft 169 between the moving abutment member 171 and the adjusting bolt 166 in a compressively deformed state. Furthermore, a plurality of main extension coil springs 167 serving as main elastic members are mounted at a location symmetrical about a point with the moving shaft 169 between the flange 171F and the fixed base 165 each in an extended state. More specifically, the fixed base 165 and the flange 171F are provided with horizontally extending spring mounting pins 165P and 171P respectively. The main extension coil springs 167 have both ends which are mounted on the spring mounting pins 165P and 171P arranged opposed to each other in the up-down direction.

In the fifth embodiment, a pair of moving shafts 169 are provided on the connection 161B of the moving base 29D so as to be juxtaposed right and left. Paired female screw holes 165N and paired adjusting bolts 166 are also provided on the fixed base 165 so as to correspond to the moving shafts 169, respectively. As a result, prevention of the overlap feed limiting member 30 from rotation is attempted. Furthermore, for example, an outer circumferential surface of the upper end of the moving shaft 169 and an inner circumferential surface of the moving abutment member 171 may be splined to each other for the purpose of preventing rotation of the overlap feed limiting member 30. The fifth embodiment can also realize an adjustment according to the thicknesses of the documents S, B by the operation of the deformation amount adjusting mechanism 165K in the same manner as the first to fourth embodiments. This can broaden the adjustable range for feeding the documents S, B one by one as compared with the conventional configuration. In the fifth embodiment as well, a female screw hole may be formed in a surface of the fixed base 165 opposed to the flange 171F in the same manner as in the second to fourth embodiments, for example. A lower end stopper bolt serving as the lower end stopper and as the lower end stopper movement operating portion may be threadingly engaged with the female screw hole. Furthermore, a female screw hole may be formed in a surface of the adjusting bolt 166 opposed to the connection 161B, and an upper end stopper bolt serving as the upper end stopper and the upper end stopper movement operating portion may be threadingly engaged with the female screw hole.

Figure 14:
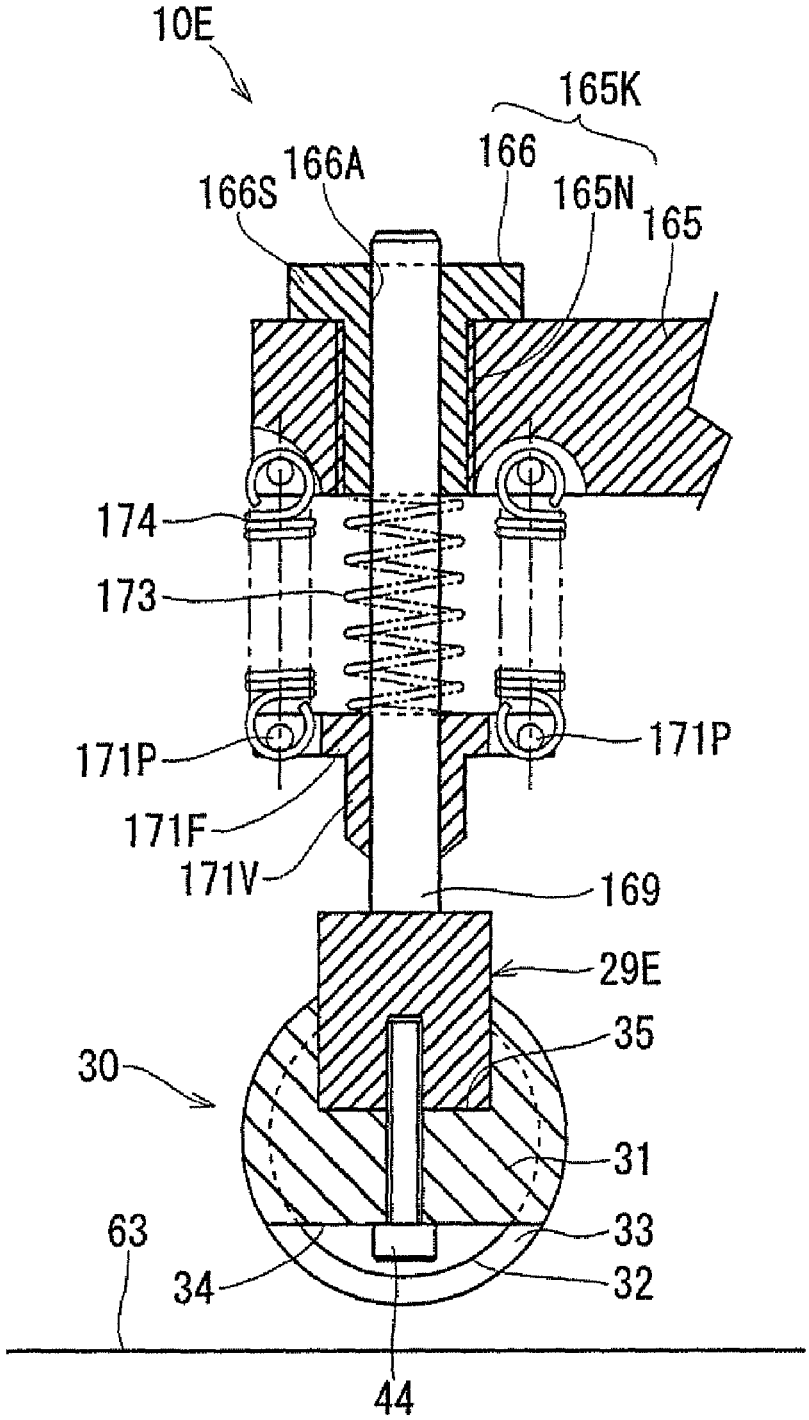
FIG. 14 is a side sectional view of a linear motion holding mechanism in accordance with a sixth embodiment.

FIG. 14 illustrates a sixth embodiment. The sixth embodiment differs from the fifth embodiment in that the adjusting bolt 166 is threadingly engaged with the female screw hole 165N of the fixed base 165 from above in the fifth embodiment. The adjusting bolt 166 and the female screw hole 165N constitute a deformation amount adjusting mechanism 165K. Furthermore, a moving abutment member 171V is welded to a part of the moving shaft 169 located lower than the fixed base 165. A plurality of sub extension coil springs 174 each serving as the sub elastic member is mounted between the flange 171F of the movable abutting member 171V and the fixed base 165 in an extended state. A main compression coil spring 173 serving as the main elastic member is provided about the moving shaft 169 in a compressed state.

In the sixth embodiment, too, a pair of moving shafts 169 are provided on the connection 161B of a moving base 29E so as to be juxtaposed right and left. Paired female screw holes 165N and paired adjusting bolts 166 are also provided on the fixed base 165 so as to correspond to the moving shafts 169, respectively. Furthermore, for example, a female screw hole may be formed in a surface of the fixed base 165 opposed to the flange 171F. An upper end stopper bolt serving as the upper end stopper and as the upper end stopper movement operating portion may be threadingly engaged with the female screw hole. Furthermore, a female screw hole may be formed in the fixed base 165 deviated from an opposed surface to the flange 171F, and a hook-shaped lower end stopper hook bolt serving as the lower end stopper and the lower end stopper movement operating portion may be threadingly engaged with the female screw hole and may be disposed on the underside of the flange 171F.

Figure 15:
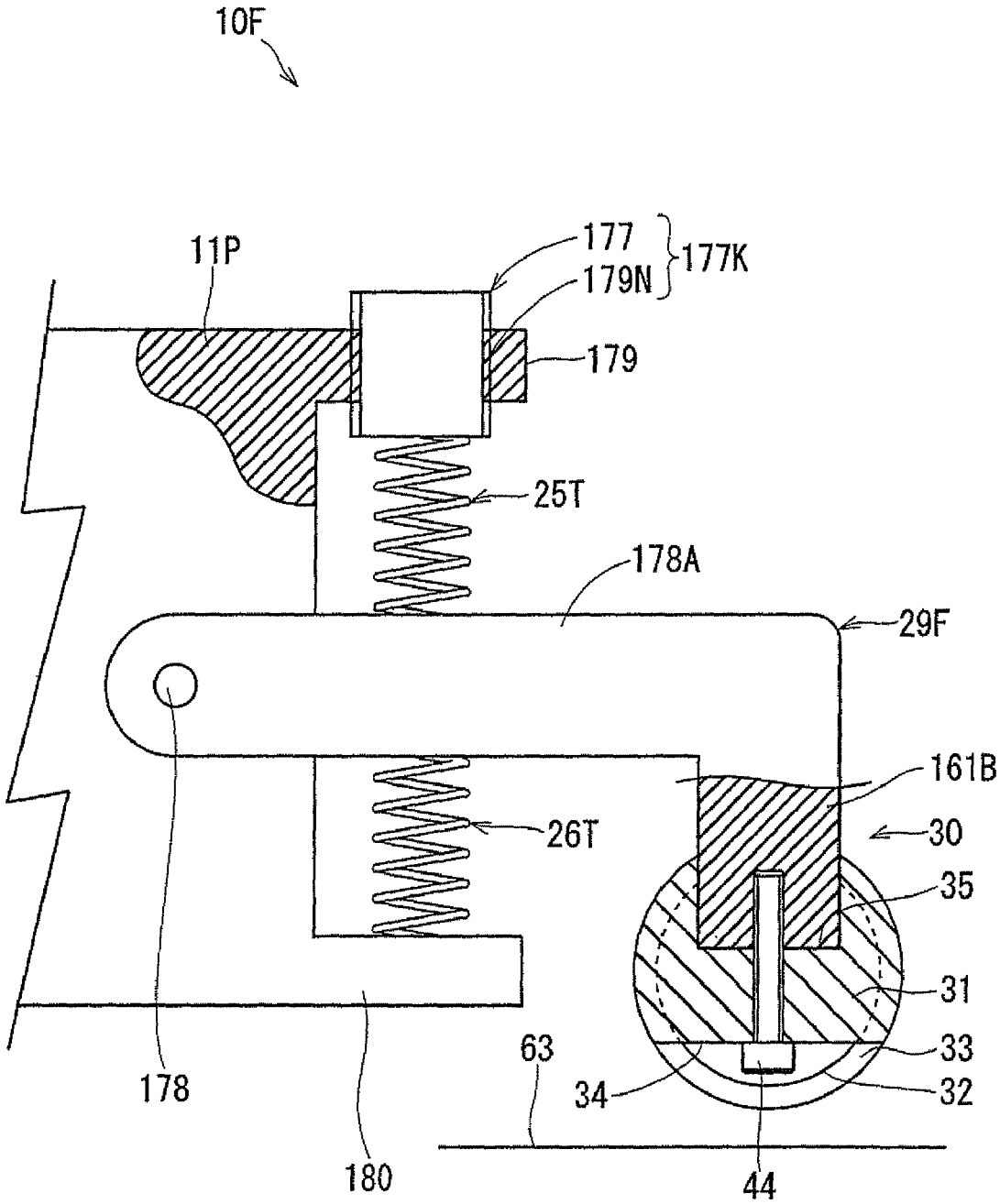
FIG. 15 is a side sectional view of a linear motion holding mechanism in accordance with a seventh embodiment.

FIG. 15 illustrates a seventh embodiment. The seventh embodiment differs from the first to sixth embodiments in structure of a linear motion support mechanism 10F. Upper and lower pressure bearing walls 179 and 180 opposed to each other in the up-down direction are provided on a fixed base 11P of the linear motion support mechanism 10F. The upper pressure bearing wall 179 is formed with a female screw hole 179N extending therethrough in the up-down direction. An adjusting nut 177 in threading engagement with the female screw hole 179N constitutes a part of the upper pressure bearing wall 179. The adjusting nut 177 and the female screw hole 179N constitute a deformation amount adjusting mechanism 177K.

A moving base 29F of the seventh embodiment is provided with a pivot lever 178A which is pivotally supported on the fixed base 11P. The pivot lever 178A extends substantially in the horizontal direction and is reciprocable in the up-down direction. The pivot lever 178A is coupled by a pivot pin 178 so as to be pivotable at an intermediate position between the upper and lower pressure bearing walls 179 and 180 in the up-down direction of the fixed base 11P main body (a part except for the upper and lower pressure bearing walls 179 and 180). The pivot lever 178A extends in the direction of protrusion of the upper and lower pressure bearing walls 179 and 180. The pivot lever 178A includes the connection 161B formed by bending a distal end thereof downward at a right angle. The connection 161B has a lower end to which the overlap feed limiting member 30 is fixed.

A main compression coil spring 25T serving as the main elastic member is mounted between the pivot lever 178A and the adjusting nut 177, and a sub compression coil spring 26T serving as the sub elastic member is mounted between the pivot lever 178A and lower pressure bearing wall 180. The seventh embodiment can also realize an adjustment according to the thicknesses of the documents S, B by the operation of the deformation amount adjusting mechanism 177K in the same manner as the first to sixth embodiments. This can broaden the adjustable range for feeding the documents S, B one by one as compared with the conventional configuration.

In the seventh embodiment as well, a female screw hole may be formed in a surface of the lower pressure bearing wall 180 opposed to the pivot lever 178A, and a lower end stopper bolt serving as the lower end stopper and as the lower end stopper movement operating portion may be threadingly engaged with the female screw hole in the same manner as the second to fifth embodiments, for example. Furthermore, a female screw hole may be formed in a surface of the upper pressure bearing wall 179 opposed to the pivot lever 178A, and an upper end stopper bolt serving as the upper end stopper and as the upper end stopper movement operating portion may be threadingly engaged with the female screw hole.

Figure 16:
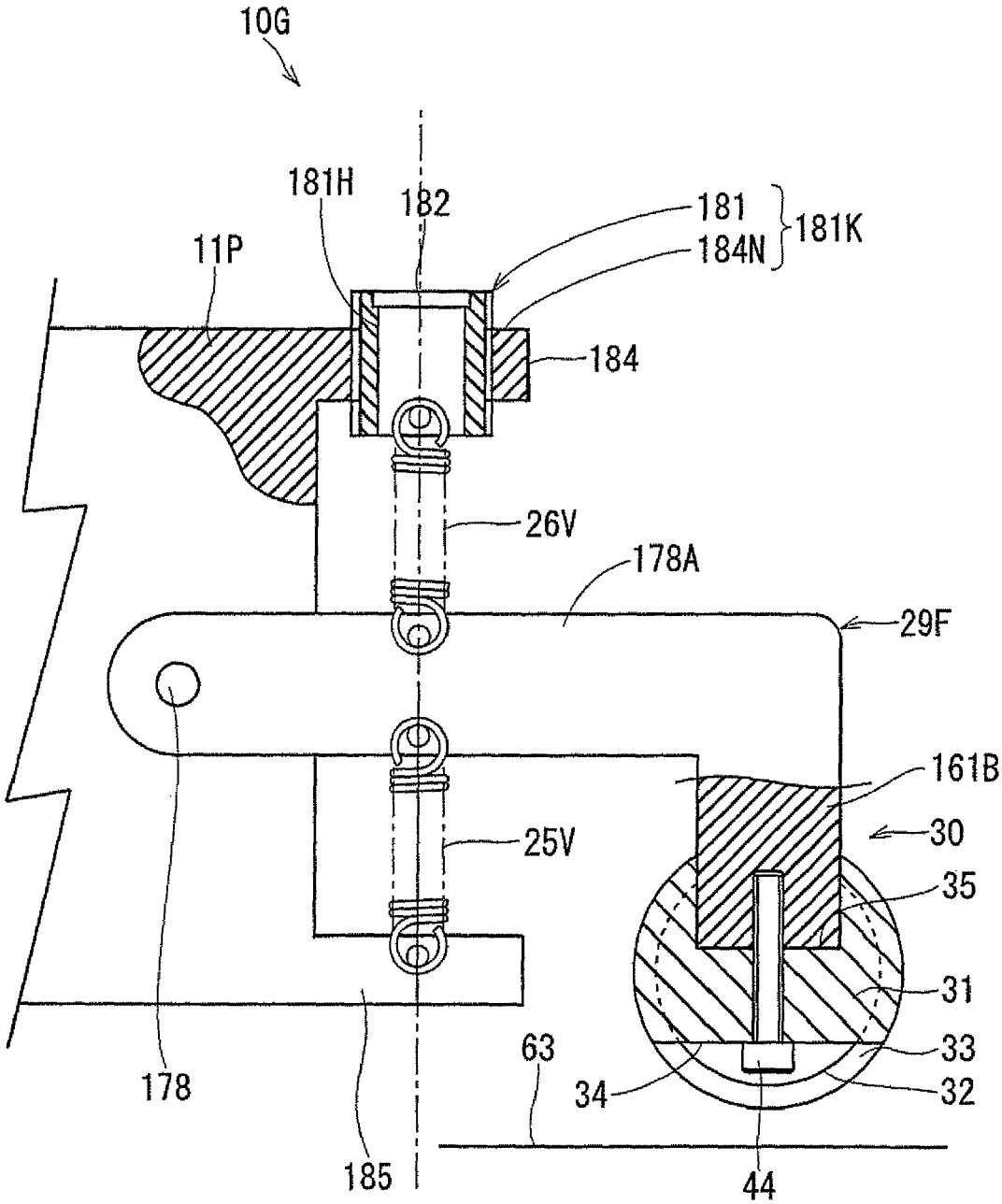
FIG. 16 is a side sectional view of a linear motion holding mechanism in accordance with an eighth embodiment.

FIG. 16 illustrates an eighth embodiment. In the eighth embodiment, a linear motion support mechanism 10G includes a main extension coil spring 25V and a sub extension coil spring 26V, instead of the main and sub compression coil springs 25T and 26T described in the seventh embodiment. More specifically, the main extension coil spring 25V is mounted in an extended state while both ends thereof are locked by the pivot lever 178A and the lower support wall 185 respectively. On the other hand, the sub extension coil spring 26V is mounted in an extended state while both ends thereof are locked by the pivot lever 178A and the upper support wall 184 respectively. Furthermore, an adjusting nut 181 is threadingly engaged with a female screw hole 184N passing through the upper support wall 184 in the up-down direction. The adjusting nut 181 has a centrally located through hole 181H in which a core member 182 is accommodated so as to be rotatable. The sub extension coil spring 26V is mounted in an extended state while both ends thereof are locked by the core member 182 and the pivot lever 178A respectively. The adjustment according to the thicknesses of the documents S, B by operation of a deformation amount adjusting mechanism 181K composed of the adjusting nut 181 and the female screw hole 184N is realized.

Additionally, in the eighth embodiment as well as the seventh embodiment, for example, a female screw hole may be formed in a surface of the lower support wall 185 opposed to the pivot lever 178A, and a lower end stopper bolt serving as the lower end stopper and as the lower end stopper movement operating portion may be threadingly engaged with the female screw hole. Furthermore, a female screw hole may be formed in a surface of the upper support wall 184 opposed to the pivot lever 178A, and an upper end stopper bolt serving as the upper end stopper and as the upper end stopper movement operating portion may be threadingly engaged with the female screw hole.

Figure 17:
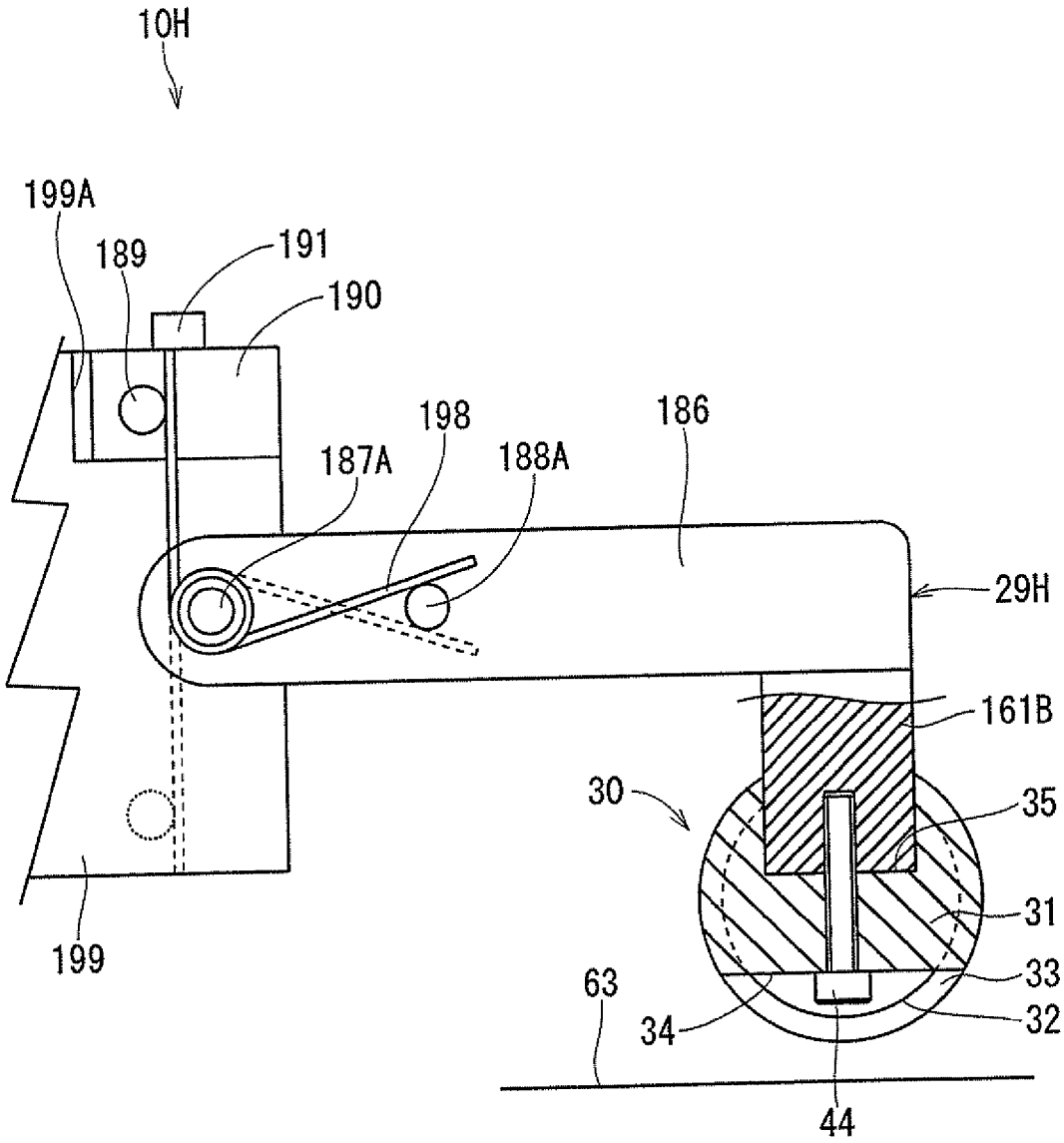
FIG. 17 is a side sectional view of a linear motion holding mechanism in accordance with a ninth embodiment.
Figure 18:
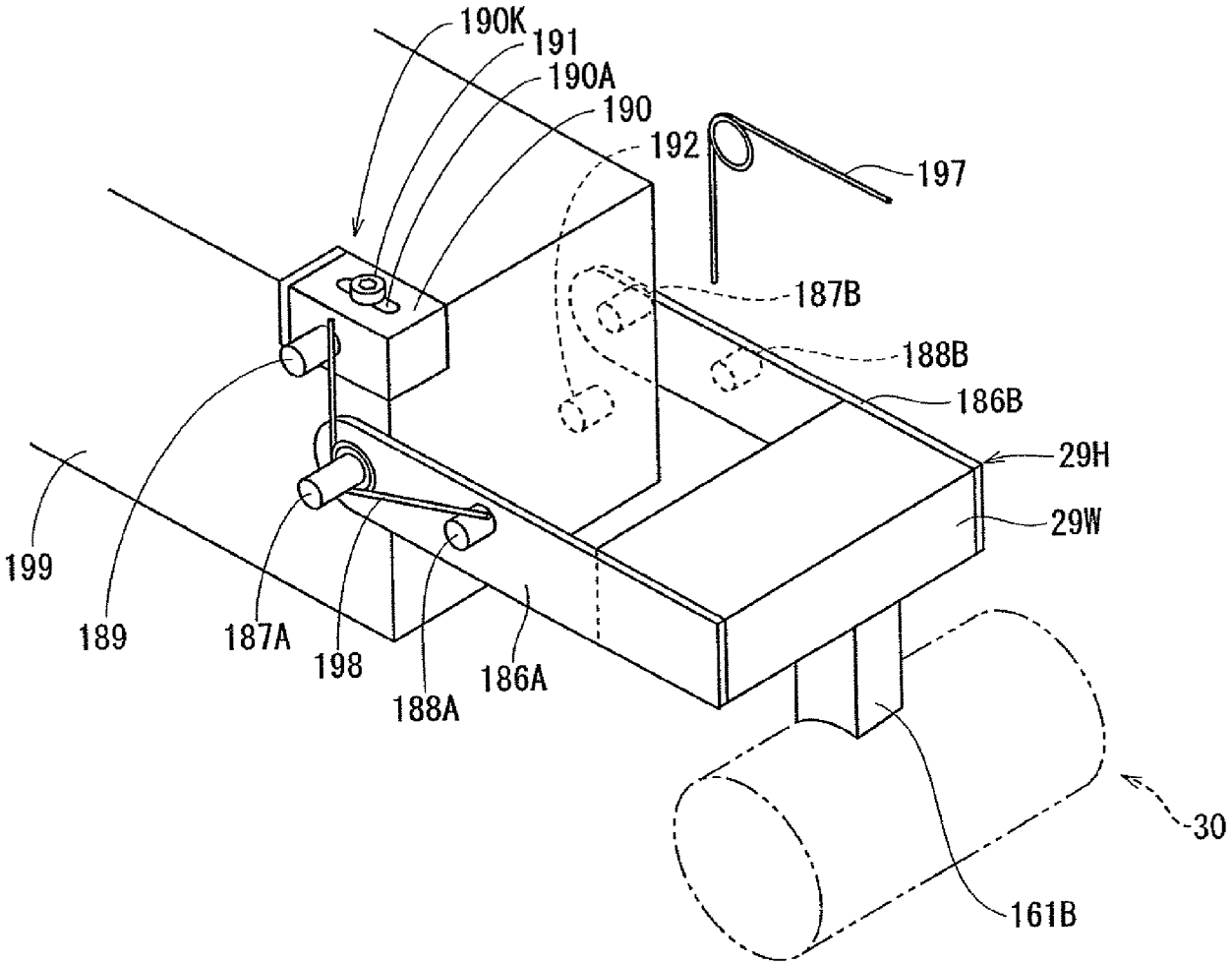
FIG. 18 is a perspective view of the linear motion holding mechanism in accordance with the ninth embodiment.

FIGS. 17 and 18 illustrate a ninth embodiment. The ninth embodiment differs from the first to eighth embodiments in structure of a linear motion support mechanism 10H. In the linear motion support mechanism 10H, a fixed base 199 has two side surfaces from which paired pivot support pins 187A and 187B are disposed coaxially and protrude in opposite directions, as shown in FIG. 18. A pair of pivot levers 186A and 18613 provided on a moving base 29H are rotatably supported on the paired pivot support pins 187A and 187B respectively and extend horizontally. Furthermore, the pivot levers 186A and 186B have respective distal ends which are connected by a horizontal connecting member 29W. The overlap feed limiting member 30 is fixed to a lower end of a connection 161B hanging downward from the horizontal connecting member 29W.

A pair of middle pins 188A and 18813 protrude in parallel with the pivot support pins 187A and 187B from a longitudinal middle part of the outer surfaces of the pivot levers 186A and 186B respectively. Furthermore, an upper base pin 189 protrudes in parallel with the pivot support pin 187A from a location above the pivot support pin 187A on one outer side surface of the fixed base 199. A lower base pin 192 protrudes in parallel with the pivot support pin 187B from a location below the pivot support pin 187B on the other outer side surface of the fixed base 199.

A main torsion coil spring 198 includes a coil portion supported on the pivot support pin 187A and has one of two ends which is in abutment with the upper base pin 189 and the other end which is in abutment with the middle pin 188A. The main torsion coil spring 198 biases the pivot lever 186A downward. Furthermore, a sub torsion coil spring 197 includes a coil portion supported on the other pivot support pin 187B. The sub torsion coil spring 197 has one of two ends which is in abutment with the lower base pin 192 and the other end which is in abutment with the middle pin 188B. The sub torsion coil spring 197 biases the pivot lever 186B upward.

A deformation amount adjusting mechanism 190K in the ninth embodiment is configured to linearly move a part of the fixed base 199 supporting the upper base pin 189 and to fix the part of the fixed base 199 at an arbitral position. Consequently, the deformation amount adjusting mechanism 190K can change an amount of elastic deformation of each of the main and sub torsion coil springs 198 and 197. More specifically, an elongate hole 190A is formed in a moving block 190 of the fixed base 199 supporting the upper base pin 189. A bolt 191 is inserted through the elongate hole 190A and threadingly engaged with a main part of the fixed base 199. The bolt 191 is loosened so that the moving block 190 is moved to an arbitral longitudinal position. The bolt 191 is tightened so that the moving block 190 is fixed. Thus, an amount of elastic deformation of each of the main and sub torsion coil springs 198 and 197 is changed. The above-described configuration of the ninth embodiment can achieve the same effect as the foregoing first to eighth embodiments.

The present invention should not be restricted to the foregoing embodiments, and the following embodiments are also included in the scope of the present invention. The embodiments may further be modified in various ways other than described as follows without departing from the gist.

1. Amounts of elastic deformation of the main and sub elastic members are changeable by the threading engagement in the first to ninth embodiments. However, for example, amounts of elastic deformation of the main and sub elastic members may be changeable by inserting a spacer into a gap between parts.

2. Although the conveying belt 63 is provided as the rotating member in the first to ninth embodiments, the rotating member may be a friction roller, instead.

3. Although the main and sub elastic members are coil springs in the first to eighth embodiments, the main and sub elastic members may be leaf springs, disc springs, rubber or the like.

4. In the first embodiment, the booklet B of the forwarding document set is detected, and a set of forwarding documents ranging from the aforesaid booklet to the sheet S immediately before the booklet B of the subsequent forwarding document set is stacked on the collector 126. However, a set of forwarding documents may range from the sheet next to the detected booklet B to a next detected booklet B and may be stacked on the collector 126, thereby being sequentially discharged.

5. In the first embodiment, the first page markers FM are printed on only the booklets B, and the document with the first page mark FM is determined as the booklet B. However, identifiers such as characters or patterns may be printed on only the sheets S, and each document without an identifier may be determined as a booklet B. Furthermore, when the beginning of the forwarding document set is a sheet S, a first page mark FM may be printed on the beginning sheet S.

Additional Statement

Figure 19:
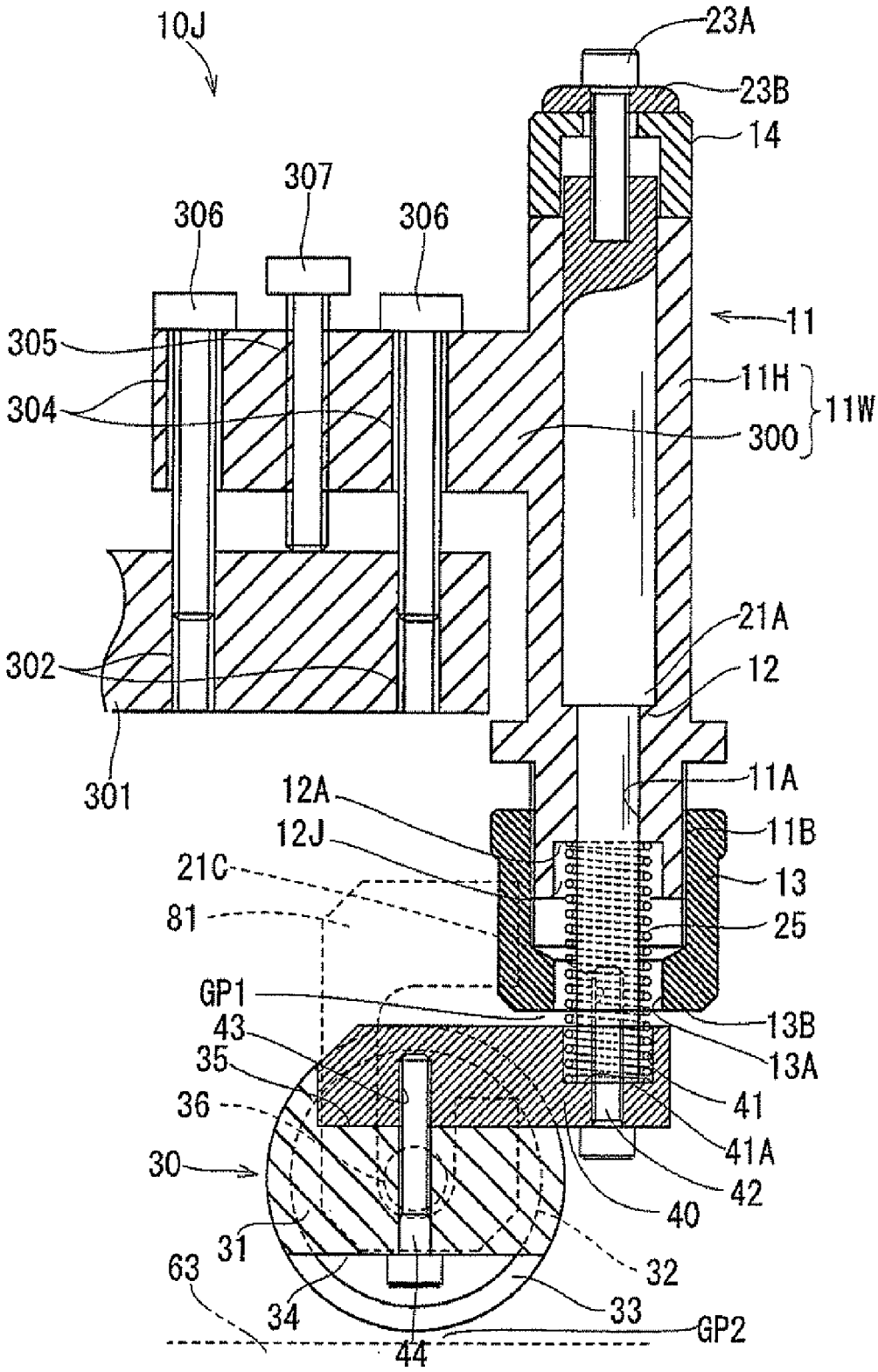
FIG. 19 is a perspective view of a linear motion holding mechanism of an additional statement.
Figure 20:
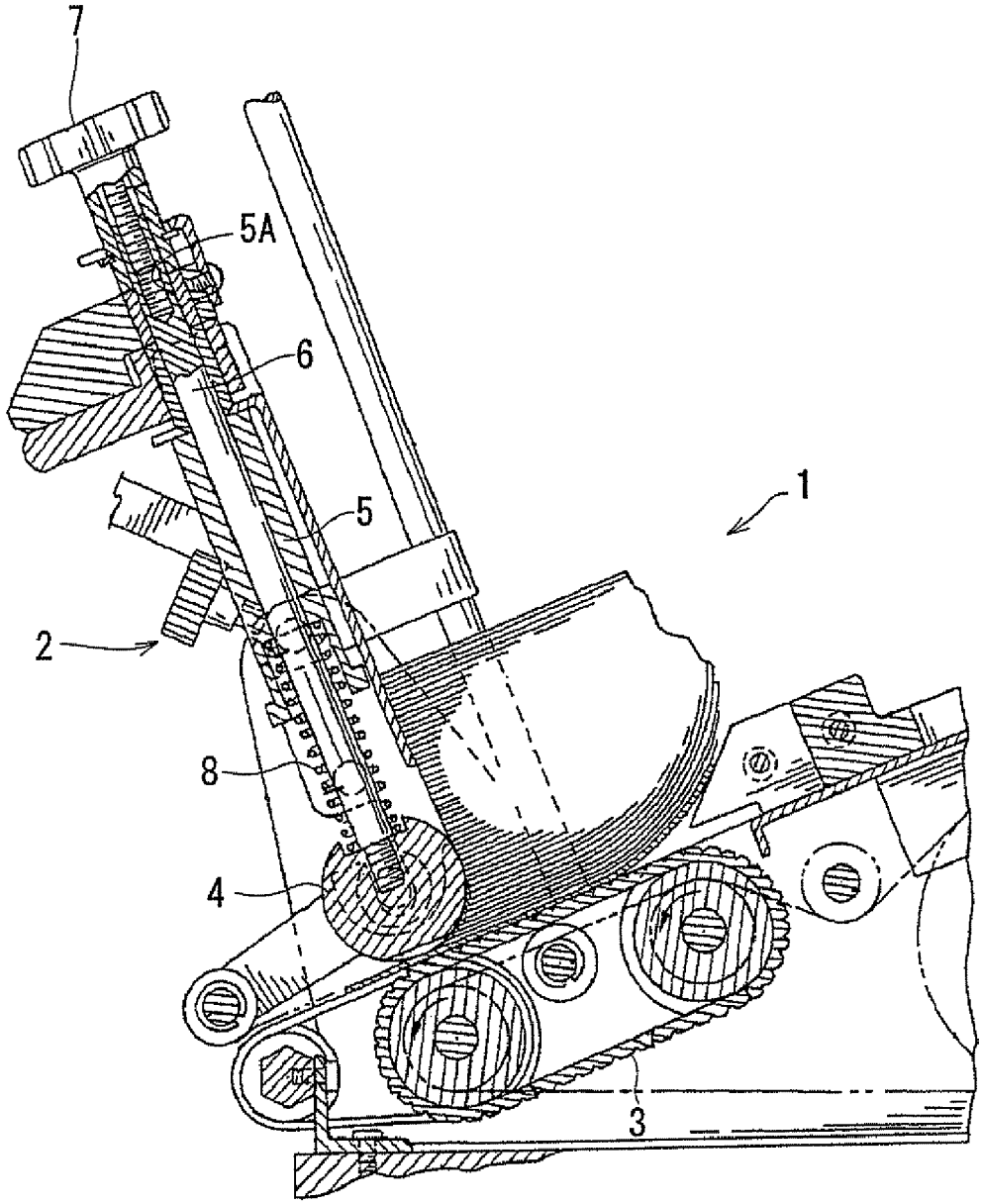
FIG. 20 is a sectional view of a conventional feeding apparatus.
Figure 21:
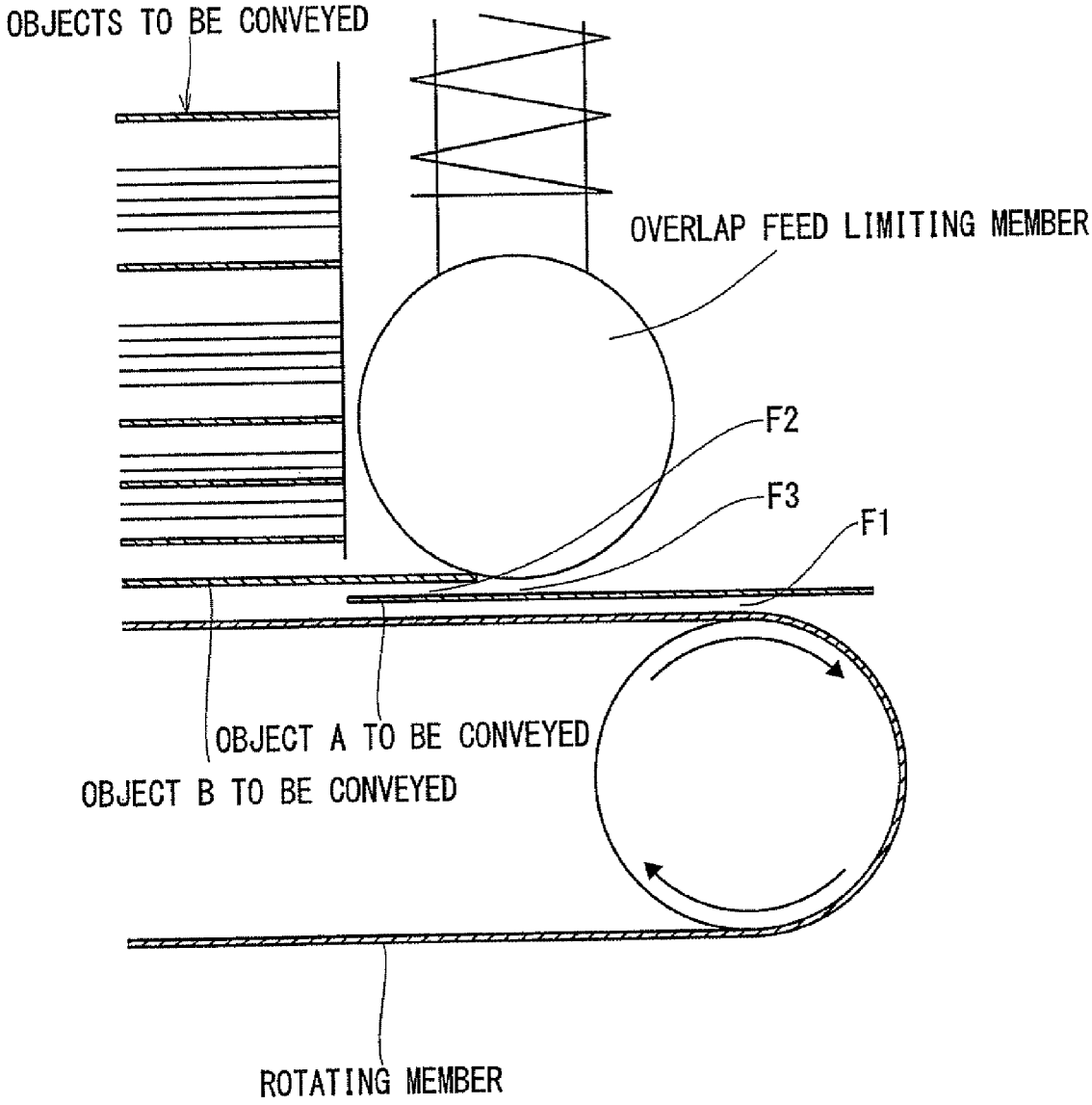

A linear motion support mechanism 10J as shown in FIG. 19 can achieve the same effect as the first embodiment although the mechanism does not belong to the technical scope. More specifically, the linear motion support mechanism 10J as shown in FIG. 19 does not have the sub compression coil spring 26, and the pressing washer 23B is abutted on the upper surface of the head cap 14 by the spring force of the main compression coil spring 25. Furthermore, the linear motion support mechanism 10J is provided with an intermediate support base 11W structured so that a combining protruding wall 300 protrudes rearward from the fixed base body 11H of the fixed base 11 in the first embodiment. A fixed protruding wall 301 extends forward from the stack loading section 70 (see FIG. 2), and the combining protruding wall 300 is disposed above the fixed protruding wall 301. The combining protruding wall 300 is formed with a pair of screw insertion holes 304 passing therethrough in the up-down direction. The fixed protruding wall 301 is formed with a pair of female screw holes 302 with which bolts 306 inserted through the pair of screw insertion holes 304 from above are threadingly engaged, respectively. The combining protruding wall 300 has a female screw hole 305 which is located between the paired screw insertion holes 304 and extends therethrough. An opposed bolt 307 is threadingly engaged with the female screw hole 305 from above and penetrates the combining protruding wall 300, and a lower end of the opposed bolt 307 is butted with an upper surface of the fixed protruding wall 301. By the above-described structure, an entire part of the intermediate support base 11W which supports the moving shaft 20 linearly movably is movable in the up-down direction relative to the stack loading section 70.

More specifically, there is provided an apparatus for feeding sheets, booklets or the like, which includes a stack loading section on which a plurality of thin objects to be conveyed such as sheets, booklets or the like are stacked and loaded in an up-down direction, a rotating member which is brought into frictional contact with the objects to extract forward sequentially from a lower end side of the stack loading section, thereby slidingly feeding the objects, and an overlap feed limiting member disposed in front of the stack loading section to hold the extracted objects between the rotating member and itself, wherein the objects which are allowed to pass between the rotating member and the overlap feed limiting member are limited to one by one, characterized by a moving base supporting the overlap feed limiting member, an intermediate support base supporting the moving base vertically movably, a main elastic member which is provided between the moving and intermediate support bases in an elastically deformed state, the main elastic member imparting a main spring force to the moving base, the main spring force acting to press the overlap feed limiting member against the object, and a fixed base which can move the intermediate support base upward and downward and fix the intermediate support base at any position. Even this feeding apparatus can achieve the same effect as the feeding apparatus 100 of the first embodiment. In other words, the feeding apparatus 100 of the first embodiment can achieve the same effect by a simpler structure than the feeding apparatus provided with the linear motion support mechanism 10J as shown in FIG. 19.

EXPLANATION OF REFERENCE SYMBOLS

10, 10A to 10H, 10J . . . linear motion support mechanism;
11, 11P, 11S, 162, 165, 199 . . . fixed base;
11A, 151A, 152C, 154H, 162A, 166A . . . shaft insertion hole;
12, 21A . . . lower end stopper;
13 . . . bottom cap (upper end stopper movement operating portion, upper end stopper);
20, 20P, 163, 169 . . . moving shaft;
21P . . . middle abutment
22C, 152K, 158K, 163K, 165K, 177K, 181K, 190K . . . deformation amount adjusting mechanism;
23A . . . upper end adjusting bolt;
23B . . . pressing washer (upper end pressurizing member, elastic member abutment);
25, 25P, 25S, 25T, 173 . . . main compression coil spring (main elastic member);
25V, 167 . . . main extension coil spring (main elastic member);
26, 26P, 26S, 26T, 168 . . . sub compression coil spring (sub elastic member);
26V, 174 . . . sub extension coil spring (sub elastic member);
29, 29D, 29E, 29F, 29H, 29M, 29P, 29S . . . moving base;
30 . . . overlap feed limiting member;
40 . . . connecting block (lower end pressurizing member, elastic member abutment);
42 . . . lower end adjusting bolt (lower end stopper movement operating portion);
63 . . . conveying belt (rotating member);
70 . . . stack loading section;
100 . . . feeding apparatus;
131 . . . mark reader (determining sensor);
151 . . . lower shaft support wall (elastic member abutment);
152 . . . adjusting nut (elastic member abutment);
153 . . . upper end elastic member bearing portion (elastic member abutment);
154 . . . fixed shaft;
155 . . . lower end elastic member bearing portion (elastic member abutment);
160 . . . upper spring abutment plate (upper end pressurizing member, elastic member abutment);
161 . . . lower spring abutment plate (lower end pressurizing member, elastic member abutment);
166 . . . adjusting bolt (fixed base, elastic member abutment);
171, 171V . . . movable abutting member (elastic member abutment);
177 . . . adjusting nut (upper pressure bearing wall, elastic member abutment);
178A . . . pivot lever
179 . . . upper pressure bearing wall;
180 . . . lower pressure bearing wall (elastic member abutment);
181 . . . adjusting nut (upper support wall);
182 . . . core member (elastic member mount);
184 . . . upper support wall;
185 . . . lower support wall (elastic member mount);
186A, 186B . . . pivot lever;
197 . . . sub torsion coil spring (sub elastic member);
198 . . . main torsion coil spring (main elastic member);
200 . . . system for sorting forwarding documents;
GP1 . . . rise allowing gap
GP2 . . . nip gap;
B . . . booklet (object to be conveyed);
S . . . sheet (object to be conveyed); and
FM . . . first page mark

The invention claimed is:

1. An apparatus for feeding sheets, booklets or the like, comprising:

a stack loading section on which a plurality of thin objects to be conveyed such as sheets, booklets or the like are stacked and loaded in an up-down direction;

a rotating member which is brought into frictional contact with the objects sequentially from a lower end side of the stack loading section, thereby extracting forward and slidingly feeding the objects; and an overlap feed limiting member disposed in front of the stack loading section to hold the extracted objects between the rotating member and said limiting member, wherein the objects which are allowed to pass between the rotating member and the overlap feed limiting member are limited to one by one, the apparatus further comprising:

a moving base supporting the overlap feed limiting member;

a fixed base supporting the moving base vertically movably;

a main elastic member which is mounted between the moving and fixed bases in an elastically deformed state, the main elastic member imparting a main elastic force to the moving base, said main elastic force acting to press the overlap feed limiting member against the object;

a sub elastic member which is mounted between the moving and fixed bases in an elastically deformed state, the sub elastic member imparting a sub elastic force to the moving base, said sub elastic force acting in a direction opposite to the main elastic force; and a deformation amount adjusting mechanism which changes amounts of elastic deformation of the respective main and sub elastic members in a non-hold state where no object is held between the rotating member and the overlap feed limiting member.

2. The feeding apparatus according to claim 1, further comprising:

a shaft inversion hole passing through the fixed base vertically;

a moving shaft provided on the moving base so as to extend upward/downward, inserted through the shaft insertion hole and having upper and lower ends both projecting outside the shaft insertion hole;

an upper end pressurizing member provided on the upper end of the moving shaft so as to be moved upward/downward together with the moving shaft and being opposed to the fixed base from above; and a lower end pressurizing member provided on the lower end of the moving shaft so as to be moved upward/downward together with the moving shaft and being opposed to the fixed base from below, wherein:

the main elastic member is mounted between the lower end pressurizing member and the fixed base in a vertically compressively deformed state;

the sub elastic member is mounted between the upper end pressurizing member and the fixed base in a vertically compressively deformed state; and the deformation amount adjusting mechanism changes and fixes a distance between a pair of elastic member abutment portions of the upper and lower end pressurizing members, against which portions the main and sub elastic members abut respectively.

3. The feeding apparatus according to claim 1, further comprising:

an upper shaft support wall and a lower shaft support wall both of which are provided on the fixed base and are opposed to each other in the up-down direction;

shaft insertion holes passing through the upper and lower shaft support walls in the up-down direction respectively;

a moving shaft which is provided on the moving base so as to extend in the up-down direction, the moving shaft having two vertical portions inserted through the shaft insertion holes of the upper and lower shaft support walls so as to be supported movably in the up-down direction, respectively; and an intermediate abutment which bulges sideways from a middle portion of the moving shaft and is movable together with the moving shaft in the up-down direction, the intermediate abutment being opposed to the upper and lower shaft support walls in the up-down direction, wherein:

the main elastic member is mounted between the intermediate abutment and the upper shaft support wall in a vertically compressively deformed state;

the sub elastic member is mounted between the intermediate abutment and the lower shaft support wall in a vertically compressively deformed state; and the deformation amount adjusting mechanism changes and fixes a distance between a pair of elastic member abutment portions of the upper and lower shaft support walls, against which portions the main and sub elastic members abut respectively.

4. The feeding apparatus according to claim 1, further comprising:

a fixed shaft which is provided on the fixed base so as to extend in the up-down direction;

an upper end elastic member receiving portion and a lower end elastic member receiving portion both of which are provided on the fixed base so as to be disposed on both vertical ends of the fixed shaft, the upper and lower end elastic member receiving portions being opposed to each other in the up-down direction; and a vertical slide provided on the moving base and having a shaft insertion hole through which the fixed shaft extends in the up-down direction, the vertical slide being disposed between the upper and lower end elastic member receiving portions, wherein:

the main elastic member is mounted between the vertical slide and the upper end elastic member receiving portion in a vertically compressively deformed state;

the sub elastic member is mounted between the vertical slide and the lower end elastic member receiving portion in a vertically compressively deformed state; and the deformation amount adjusting mechanism changes and fixes a distance between a pair of elastic member abutment portions of the upper and lower end elastic member receiving portions, against which portions the main and sub elastic members abut respectively.

5. The feeding apparatus according to claim 1, further comprising:

a shaft insertion hole passing through the fixed base in the up-down direction;

a moving shaft which is provided on the moving base so as to extend in the up-down direction and is inserted through the shaft insertion hole, the moving shaft having upper and lower ends protruding out of the shaft insertion hole; and a moving abutment member which is movable together with the moving shaft in the up-down direction and is opposed to the fixed base from above, wherein:

the main elastic member has upper and lower ends mounted on the moving abutment member and the fixed base in a vertically tensionally deformed state;

the sub elastic member is mounted between the moving abutment member and the fixed base in a vertically compressively deformed state; and the deformation amount adjusting mechanism changes and fixes a distance between a pair of elastic member abutment portions of the moving abutment member and fixed base, against which portions both ends of the sub elastic member abut respectively.

6. The feeding apparatus according to claim 1, further comprising:

a shaft insertion hole passing through the fixed base in the up-down direction;

a moving shaft which is provided on the moving base so as to extend in the up-down direction and is inserted through the shaft insertion hole, the moving shaft having upper and lower ends protruding out of the shaft insertion hole; and a moving abutment member which is movable together with the moving shaft in the up-down direction and is opposed to the fixed base from below, wherein:

the main elastic member is mounted between the moving abutment member and the fixed base in a vertically compressively deformed state;

the sub elastic member has upper and lower ends mounted on the moving abutment member and the fixed base in a vertically tensionally deformed state; and the deformation amount adjusting mechanism changes and fixes a distance between a pair of elastic member abutment portions of the moving abutment member and fixed base, against which portions both ends of the main elastic member abut respectively.

7. The feeding apparatus according to claim 1, further comprising:

a pivotal lever which is provided on the moving base and pivotally supported on the fixed base so as to extend substantially horizontally and so as to be reciprocable vertically; and an upper pressure bearing wall and a lower pressure bearing wall both of which are provided on the fixed base so as be opposed to each other in the up-down direction with the pivotal lever being interposed therebetween, wherein:

the main elastic member is mounted between the upper pressure bearing wall and the pivotal lever in a vertically compressively deformed state;

the sub elastic member is mounted between the lower pressure bearing wall and the pivotal lever in a vertically compressively deformed state; and the deformation amount adjusting mechanism changes and fixes a distance between a pair of elastic member abutment portions of the upper and lower pressure bearing walls, against which portions the main and sub elastic members abut respectively.

8. The feeding apparatus according to claim 1, further comprising:

a pivotal lever which is provided on the moving base and pivotally supported on the fixed base so as to extend substantially horizontally and so as to be reciprocable vertically; and an upper support wall and a lower support wall both of which are provided on the fixed base so as be opposed to each other in the up-down direction with the pivotal lever being interposed therebetween, wherein:

the main elastic member is mounted between the lower support wall and the pivotal lever in a vertically tensionally deformed state;

the sub elastic member is mounted between the upper support wall and the pivotal lever in a vertically tensionally deformed state; and the deformation amount adjusting mechanism changes and fixes a distance between a pair of elastic member abutment portions of the upper and lower support walls, on which portions the main and sub elastic members are mounted respectively.

9. The feeding apparatus according to claim 1, further comprising:

a pivotal lever which is provided on the moving base and pivotally supported on the fixed base so as to extend substantially horizontally and so as to be reciprocable vertically;

a main torsion coil spring serving as the main elastic member and having one of two ends which abuts against a part of the pivotal lever and the other end which abuts against a part of the fixed base, thereby biasing the pivotal lever downward; and a sub torsion coil spring serving as the sub elastic member and having one of two ends which abuts against another part of the pivotal lever and the other end which abuts against another part of the fixed base, thereby biasing the pivotal lever upward, wherein the deformation amount adjusting mechanism is provided on the fixed base and moves and fixes the part against which either the main or sub torsion coil spring abuts to any position about a twisted axis of the torsion coil spring.

10. The feeding apparatus according to claim 3, wherein the main and sub elastic members comprise compression coil springs inserted through the moving shaft respectively.

11. The feeding apparatus according to claim 4, wherein the main and sub elastic members comprise compression coil springs inserted through the fixed shaft respectively.

12. The feeding apparatus according to claim 5, wherein one of the main and sub elastic members which is compressively deformed comprises a compression coil spring inserted through the moving shaft, and the other elastic member comprises a plurality of tension coil springs disposed about the moving shaft.

13. The feeding apparatus according to claim 1, wherein the deformation amount adjusting mechanism is provided with a male thread and a female screw hole both of which are threadingly engaged with each other, and the deformation amount adjusting mechanism changes elastic deformation amounts of the main and sub elastic members by changing a depth of threading engagement of the male thread and the female screw hole.

14. The feeding apparatus according to claim 1, further comprising a lower end stopper which is provided on a lower end of the fixed base and abuts against the moving base when the moving base is moved downward thereby to forbid the moving base from moving downward from the abutment position, and a lower end stopper movement operating portion which renders the lower end stopper movable in the up-down direction by a threading engagement operation.

15. The feeding apparatus according to claim 1, wherein the overlap feeding limiting member is disposed at a position spaced from the rotating member in the non-hold state.

16. The feeding apparatus according to claim 1, further comprising an upper end stopper which is provided on a lower end of the fixed base and abuts against the moving base when the moving base is moved upward thereby to forbid the moving base from being moved upward from the abutment position, and an upper end stopper movement operating portion which renders the upper end stopper movable in the up-down direction by a threading engagement operation.

17. The feeding apparatus according to claim 1, wherein the overlap feeding limiting member abuts against the rotating member in the non-hold state.

18. A system for sorting forwarding documents comprising:

the feeding apparatus described in claim 1, wherein a plurality of sets of forwarding documents are placed on the stack loading section in a stacked state, each set including one booklet serving as the object to be conveyed and any number of sheets serving as the object to be conveyed, the booklets and the sheets being passed between the rotating member and the overlap feed limiting member one by one from the objects to be conveyed placed on the stack loading section without discrimination between the booklet and the sheet; and an aggregating unit which determines whether the object fed one by one from the feeding apparatus is the booklet, and stacks, as a set of the forwarding documents, the objects ranging from said booklet to the sheet before a subsequent booklet or from the sheet next to said booklet to the next booklet, thereby distinguishing and sequentially discharging the forwarding document sets one by one.

19. The sorting system according to claim 18, wherein the aggregating unit is provided with a determining sensor which determines whether a character/pattern is printed on a surface of only said booklet or only said sheet out of the booklets and the sheets, and the aggregating unit determines whether the object to be conveyed is the booklet, according to results of determination by the determining sensor.

* * * * *